US012662640B2

(12) United States Patent
Reid et al.

(10) Patent No.: US 12,662,640 B2
(45) Date of Patent: Jun. 23, 2026

(54) METHOD OF REDUCING THE IMPACT OF DEPOSITS IN A POST COMBUSTION SYSTEM OF A DIESEL ENGINE

(71) Applicant: INNOSPEC LIMITED, Ellesmere (GB)

(72) Inventors: Jacqueline Reid, Ellesmere (GB); Nigel John Broom, Ellesmere (GB); Adele Cross, Ellesmere (GB)

(73) Assignee: INNOSPEC LIMITED, Ellesmere Port (GB)

( * ) Notice: Subject to any disclaimer, the term of this patent is extended or adjusted under 35 U.S.C. 154(b) by 0 days.

(21) Appl. No.: 18/638,046

(22) Filed: Apr. 17, 2024

(65) Prior Publication Data

US 2025/0326978 A1 Oct. 23, 2025

(51) Int. Cl.
*C10L 1/222* (2006.01)
*C10L 10/04* (2006.01)

(52) U.S. Cl.
CPC ..... *C10L 1/222* (2013.01); *C10L 1/2222* (2013.01); *C10L 10/04* (2013.01); *C10L 2270/026* (2013.01)

(58) Field of Classification Search
CPC ..... C10L 1/222; C10L 1/2222; C10L 10/04; C10L 2270/026
See application file for complete search history.

(56) References Cited

U.S. PATENT DOCUMENTS 5,925,151 A 7/1999 DeCanio et al.
7,291,758 B2 11/2007 Bohnenpoll et al.
10,308,888 B1 * 6/2019 Schwab ..... C10L 10/06
2008/0052985 A1 3/2008 Stevenson et al.
2008/0113890 A1 5/2008 Moreton et al.
2008/0307698 A1 12/2008 Barton et al.
2010/0299992 A1 * 12/2010 Reid ..... C10L 10/00 44/425
2011/0258917 A1 10/2011 Castro et al.
2011/0315107 A1 12/2011 Grabarse et al.
2012/0010112 A1 1/2012 Grabarse et al.
(Continued)

FOREIGN PATENT DOCUMENTS

CN 114317045 A 4/2022
EP 0152663 A1 8/1985
(Continued)

OTHER PUBLICATIONS

International Search Report (ISR) for PCT/GB2023/051111; mailed Jun. 7, 2023; 4 pages.
(Continued)

*Primary Examiner* — Ellen M Mcavoy
(74) *Attorney, Agent, or Firm* — Jason A. Smith; Shumaker, Loop & Kendrick, LLP

(57) ABSTRACT

A method of reducing the impact of deposits in a post combustion system of a diesel engine. The method comprises combusting in the engine a diesel fuel composition comprising as additives: (a) one or more quaternary ammonium salts; and (b) one or more compounds which are a product of a Mannich reaction between an (b1) aldehyde, (b2) an amine and (b3) an optionally substituted phenol. The method may be particularly effective when combusting a diesel fuel composition comprising renewable diesel.

24 Claims, 2 Drawing Sheets

(56) References Cited

U.S. PATENT DOCUMENTS

| | | | | |
|---|---|---|---|---|
| 2013/0031827 | A1 | 2/2013 | Reid et al. | |
| 2013/0031828 | A1* | 2/2013 | Reid | C10L 10/06 44/386 |
| 2013/0104826 | A1 | 5/2013 | Burgess et al. | |
| 2014/0157656 | A1* | 6/2014 | Reid | C10L 1/238 44/353 |
| 2014/0157657 | A1* | 6/2014 | Reid | C10L 1/238 123/1 A |
| 2014/0173972 | A1 | 6/2014 | Brewer et al. | |
| 2014/0173973 | A1 | 6/2014 | Brewer | |
| 2014/0174390 | A1* | 6/2014 | Reid | C10L 10/06 44/422 |
| 2014/0174391 | A1* | 6/2014 | Reid | C10L 1/2387 44/415 |
| 2017/0218291 | A1* | 8/2017 | Reid | C07C 53/10 |
| 2019/0345406 | A1 | 11/2019 | Moreton et al. | |
| 2020/0024536 | A1 | 1/2020 | Shanahan et al. | |
| 2021/0017464 | A1* | 1/2021 | Galante-Fox | C10L 1/228 |
| 2021/0024844 | A1 | 1/2021 | Taylor et al. | |
| 2022/0325195 | A1* | 10/2022 | Galante-Fox | C10L 1/2222 |
| 2023/0077913 | A1* | 3/2023 | Schwab | C10L 1/221 44/415 |

FOREIGN PATENT DOCUMENTS

| | | | |
|---|---|---|---|
| EP | 0385633 | A1 | 9/1990 |
| EP | 0565285 | A1 | 10/1993 |
| EP | 0831141 | A1 | 3/1998 |
| EP | 1254889 | A1 | 11/2002 |
| EP | 2302020 | A1 | 3/2011 |
| EP | 2631283 | A1 | 8/2013 |
| GB | 960493 | A | 6/1964 |
| GB | 2625160 | A | 3/2025 |
| WO | 2006135881 | A2 | 12/2006 |
| WO | 2007015080 | A1 | 2/2007 |
| WO | 2009040582 | A1 | 4/2009 |
| WO | 2009040583 | A1 | 4/2009 |
| WO | 2009040585 | A1 | 4/2009 |
| WO | 2010097624 | A1 | 9/2010 |
| WO | 2011095819 | A1 | 8/2011 |
| WO | 2011110860 | A1 | 9/2011 |
| WO | 2013017887 | A1 | 2/2013 |
| WO | 2013017889 | A1 | 2/2013 |
| WO | 2014066344 | A1 | 5/2014 |
| WO | 2015011505 | A1 | 1/2015 |
| WO | 2015011506 | A1 | 1/2015 |
| WO | 2015011507 | A1 | 1/2015 |
| WO | 2015183908 | A1 | 12/2015 |
| WO | 2016016641 | A1 | 2/2016 |
| WO | 2017017454 | A1 | 2/2017 |
| WO | 2020120416 | A1 | 6/2020 |
| WO | 2022084281 | A1 | 4/2022 |
| WO | 2023047134 | A1 | 3/2023 |

OTHER PUBLICATIONS

Written Opinion (WO) for PCT/GB2023/051111; mailed Jun. 7, 2023; 6 pages.

Great Britain Search Report (GBSR) for GB2206073.5; mailed Oct. 27, 2022; 3 pages.

Anonymous: "Worldwide Fuel Charter," sixth edition, Gasoline and Diesel Fuel, Oct. 18, 2019, pp. 1-105.

Lance, M. J.; Storey, J.; Lewis, S.; and Sluder, S. Analysis of Lacquer Deposits and Plugging Found in Field-Tested EGR Cooler. SAE Technical Paper (2014), 7 pages.

Lance, M. J.; Mills, Z. G.; Seylar, J. C.; Storey, J. M.; and Sluder, C. S. The Effect of Engine Operating Conditions on Exhaust Gas Recirculation Cooler Fouling. International Journal of Heat and Mass Transfer (2018), 126, 509-520.

Examination Report (ER) for GB Patent Application No. GB2306160.9; Dec. 20, 2024; 4 pages.

Examination Report (ER) for GB Patent Application No. GB2306163.3; Dec. 20, 2024; 5 pages.

Non-Final Office Action (NFOA) from U.S. Appl. No. 18/695,541; mailed on Mar. 14, 2025; 23 pages.

Non-Final Office Action (NFOA) from U.S. Appl. No. 18/859,461; mailed on Jun. 27, 2025; 8 pages.

Dabelstein, W.; Reglitzky, A.; Schutze, A.; Reders, K.; and Brunner, A.; Automotive Fuels. Ullmann's Encyclopedia of Industrial Chemistry, 2016, 1-41.

Williams, R., et al.; Developement of an Engine Test to Rate the EGR Deposit Formation Propensity of Fuels in Light-Duty Diesel Engines. SAE Int. J. Advances & Curr. Prac. in Mobility, 3(1):337-348, 2021.

Examination Report (ER1) from European Application No. 23722023.1; dated Jul. 22, 2025; 7 pages.

Examination Report (ER2) from European Application No. 23722023.1; dated Jul. 23, 2025; 9 pages.

Non-Final Office Action dated Oct. 2, 2025, issued in U.S. Appl. No. 18/695,541 (9 pages).

Office Action dated Apr. 29, 2026 issued in U.S. Appl. No. 18/859,461 (9 pages).

* cited by examiner

METHOD OF REDUCING THE IMPACT OF DEPOSITS IN A POST COMBUSTION SYSTEM OF A DIESEL ENGINE

FIELD

The present invention relates to methods and uses for improving the performance of diesel engines. In particular the invention relates to reducing the impact of deposits in the post combustion system of diesel engines, especially modern diesel engines having a high pressure fuel system running fuels comprising diesel obtained from natural or renewable sources.

BACKGROUND

The addition of detergent additives to combat deposits in the combustion system of diesel engines, for example in the fuel injection system, is well known and a wide variety of detergents have been developed for this purpose.

However less work has been carried out to combat deposits in the exhaust gas recirculation system or the post combustion system. Nevertheless, the presence of deposits in the exhaust gas recirculation system or the post combustion system of a diesel engine can have a significant deleterious effect on the performance of diesel engines, especially modern diesel engines having a high pressure fuel system.

Exhaust gas recirculation (EGR) systems are fitted to diesel vehicles to reduce $NO_x$ emissions. This is achieved by recirculating exhaust gases to the combustion chamber in a controlled manner and thereby increasing the heat capacity of and reducing the oxygen concentration in gases within the combustion chamber. Several types of EGR systems have been developed. High pressure EGR systems are arranged to divert exhaust gases from the combustion chamber, before the exhaust gases reach any turbocharger and/or diesel particulate filter present in the engine, and supply said exhaust gases to the intake manifold downstream of the compressor. The high pressure EGR system therefore operates on the high pressure sides of the intake and exhaust manifolds and supplies the combustion chamber with unfiltered recirculated exhaust gases. Low pressure EGR systems are arranged to divert exhaust gases from the combustion chamber downstream of any turbocharger and/or diesel particulate filter present in the engine, and to supply said exhaust gases to the intake tract upstream of the compressor. The low pressure EGR system therefore operates on the low pressure sides of the intake and exhaust manifolds and supplies the combustion chamber with filtered recirculated exhaust gases. Hybrid (or combined) EGR systems integrate both high pressure EGR and low pressure EGR on the same engine, to combine the benefits of each system. Dedicated EGR (D-EGR) systems are arranged to route the entire exhaust of a sub-group of power cylinders (dedicated cylinders) directly into the intake manifold.

Over time deposits can form within an EGR system. This is a particular issue in diesel engines with high pressure EGR systems, due to the recirculated exhaust gas stream being taken upstream of any turbocharger and diesel particulate filter, meaning that problematic particulate combustion products are re-introduced into the intake manifold and the combustion chamber. One area where such deposits cause a particular problem is within the cooler component of the EGR system. If the level of deposits becomes significant then the engine management systems in sophisticated diesel engines may cause the engine to operate with reduced performance and/or enter into a safe running mode. This scenario would have significant impact on the vehicle's operability and would require inspection by a suitably qualified workshop.

A typical EGR system comprises an intake pipe, a valve, a housing, a cooler and an outlet pipe. Deposits build up on the interior surfaces of all portions of the EGR system, but particularly in the cooler.

It would be beneficial to combat such deposits, particularly in the cooler of an EGR system, particularly in the cooler of a high pressure EGR system.

The post combustion system of a diesel engine typically includes a series of components through which exhaust gases must flow before exiting the vehicle. The post combustion system may include a turbocharger, a diesel oxidation catalyst, a diesel particulate filter, a selective catalytic reduction unit and an ammonia oxidation catalyst. It would be desirable to combat deposits in any or all of these components.

The formation of deposits in the post combustion system may involve the accumulation of soot on components of the post combustion system. In particular, the formation of deposits in the post combustion system may involve an accumulation and/or capture of soot in a diesel particulate filter of the post combustion system.

It would also be beneficial to prevent and/or to remove deposits on sensors within the post combustion system, for example deposits on $NO_x$ sensors, temperature sensors and/or pressure sensors.

It would also be beneficial to prevent and/or to remove the accumulation of soot on components of the post combustion system and/or to prevent and/or to remove soot from a diesel particulate filter of the post combustion system.

In recent years, environmental pressures have meant that more sustainable alternatives to fossil fuels have been increasingly investigated and used. It is now common to replace some or all of diesel fuel obtained from petroleum sources with diesel obtained from natural or renewable sources.

However inclusion of a renewable diesel component can have a significant impact on the properties of a fuel at low temperatures.

The chemical nature of renewable diesel is significantly different to that of mineral diesel. Mineral diesel is derived from petroleum and comprises a mixture of alkanes having a high degree of branching, along with aromatic and olefinic compounds.

Renewable diesel can be prepared by the hydrodeoxygenation of fats and oils and may comprise primarily straight chain or branched alkanes. The chemical composition of such a renewable diesel is significantly different to mineral diesel.

SUMMARY

The present inventors have surprisingly found that the inclusion of certain compounds as fuel additives in diesel fuel comprising diesel obtained from a natural or renewable source (i.e. not derived from petroleum), is able to combat the negative effects of deposits in the EGR system and/or the post combustion system.

DETAILED DESCRIPTION

Figure 1:
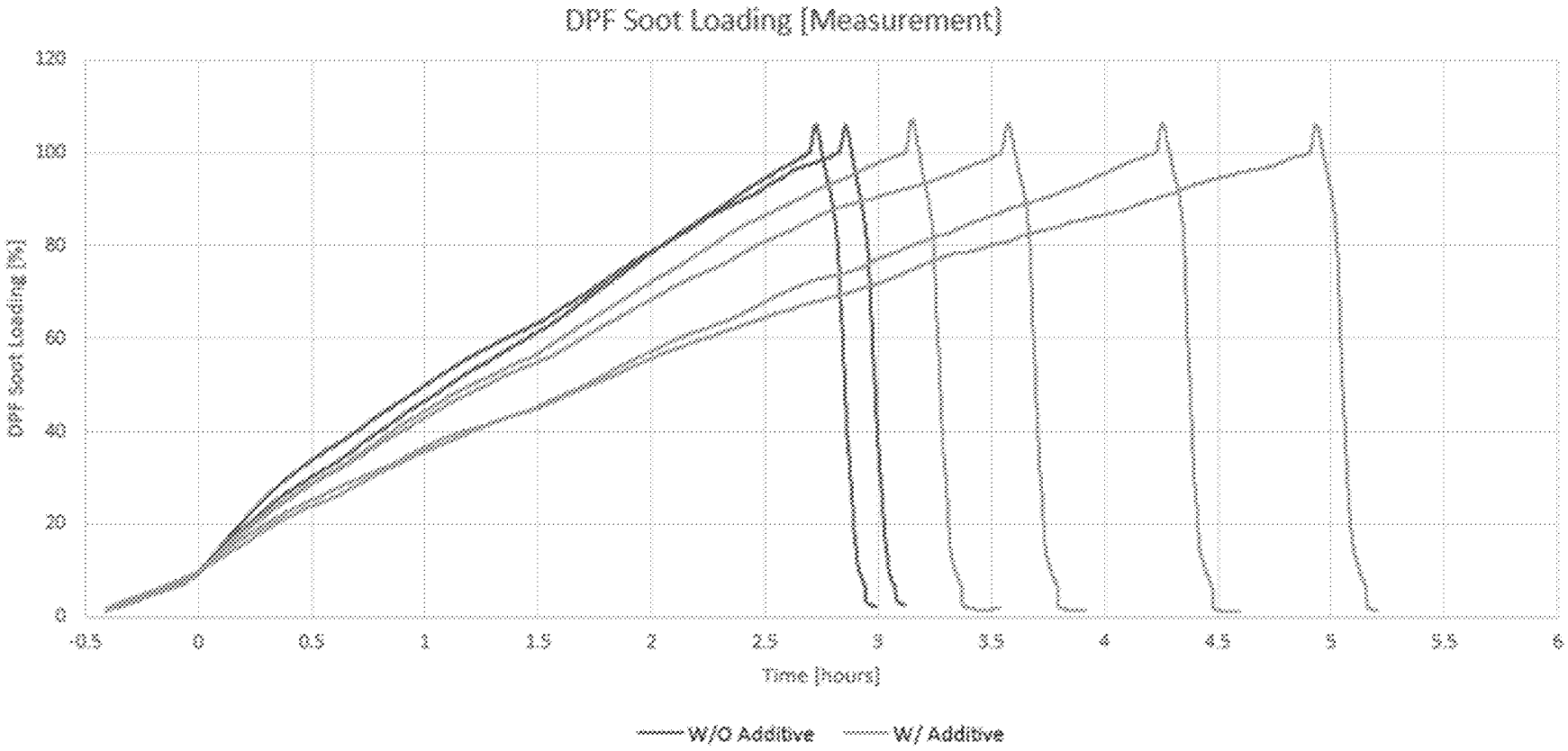
FIG. 1 shows DPF soot loading measurements with and without the additive.

According to a first aspect of the present invention there is provided the use of (a) one or more quaternary ammonium salts; and (b) one or more compounds which are a product of a Mannich reaction between (b1) an aldehyde, (b2) an amine and (b3) an optionally substituted phenol, as additives in a diesel fuel composition to reduce the impact of deposits in a post combustion system of a diesel engine when combusting said diesel fuel composition.

According to a second aspect of the present invention there is provided a method of reducing the impact of deposits in a post combustion system of a diesel engine, the method comprising combusting in the engine a diesel fuel composition comprising as additives:

(a) one or more quaternary ammonium salts; and (b) one or more compounds which are a product of a Mannich reaction between (b1) an aldehyde, (b2) an amine and (b3) an optionally substituted phenol.

The present invention relates to a method and use which reduces the impact of deposits in the EGR system and/or the post combustion system of a diesel engine. The presence of deposits on one or more parts of the post combustion system of a diesel engine typically has a negative effect on the performance of the engine.

Reducing the impact of deposits may involve reducing or preventing the formation of deposits and/or removing existing deposits and/or changing the nature of the deposits.

In some embodiments reducing the impact of deposits may involve changing the nature of deposits. This means that the structure or composition of deposits which are formed is different in a way that is less detrimental to the performance of the engine, for example by increasing the combustibility and/or thermal conductivity of the deposits.

In some preferred embodiments reducing the impact of deposits involves reducing and/or preventing the formation of deposits and/or the removal of existing deposits.

In some embodiments the first aspect of the present invention provides the use of additives (a) and (b) to reduce the impact of deposits in the exhaust gas recirculation system of a diesel engine when combusting said diesel fuel composition.

Preferably the use reduces the formation of deposits in the EGR system.

In some embodiments the second aspect of the present invention provides a method of reducing the impact of deposits in the exhaust gas recirculation system of a diesel engine, the method comprising combusting in the engine a diesel fuel composition comprising additives (a) and (b).

Preferably the method reduces the formation of deposits in the EGR system.

Preferably the first aspect of the present invention provides the use of additives (a) and (b) in a diesel fuel composition to reduce the impact of deposits in the post combustion system of a diesel engine when combusting said diesel fuel composition.

Preferably the second aspect of the present invention provides a method of reducing the formation of deposits in the post combustion system of a diesel engine, the method comprising combusting in the engine a diesel fuel composition comprising additives (a) and (b).

In preferred embodiments reducing the impact of deposits involves reducing and/or preventing the impact of deposits in the post combustion system of a diesel engine.

Preferred features of the first and second aspects of the invention will now be described.

The present invention involves the use of (a) one or more quaternary ammonium salts; and (b) one or more compounds which are a product of a Mannich reaction between (b1) an aldehyde, (b2) an amine and (b3) an optionally substituted phenol.

By this we mean that the invention may include the use of one additive (a) and one additive (b) or the use of multiple additives (a) and/or multiple additives (b).

For the avoidance of doubt each additive used in the present invention may comprise a mixture of compounds and references to an additive or the additive include mixtures, unless otherwise stated. In particular mixtures of isomers and mixtures of homologues are within the scope of the invention. The skilled person will appreciate that commercial sources of some of the additive compounds described herein may comprise mixtures of isomers and/or mixtures of homologues.

The use or method of the present invention may also comprise the use of one or more of the following additives:

(c) the reaction product of a carboxylic acid-derived acylating agent and an amine;

(d) the reaction product of a carboxylic acid-derived acylating agent and hydrazine;

(e) a salt formed by the reaction of a carboxylic acid with di-n-butylamine or tri-n-butylamine; and (f) the reaction product of a hydrocarbyl-substituted dicarboxylic acid or anhydride and an amine compound or salt, which product comprises at least one amino triazole group.

(a) Quaternary Ammonium Salt Additives

Additive (a) may comprise any suitable quaternary ammonium salt additive.

Preferably the quaternary ammonium salt additive is the reaction product of a compound including a tertiary amine group and a quaternising agent.

Any suitable quaternising agent may be used. The quaternising agent may suitably be selected from esters and non-esters.

Suitable quaternising agents include esters of a carboxylic acid, dialkyl sulfates, benzyl halides, hydrocarbyl substituted carbonates, hydrocarbyl substituted epoxides optionally in combination with an acid, alkyl halides, alkyl sulfonates, sultones, hydrocarbyl substituted phosphates, hydrocarbyl substituted borates, alkyl nitrites, alkyl nitrates, hydroxides, N-oxides, chloroacetic acid or salts thereof, or mixtures thereof.

In some preferred embodiments, quaternising agents used to form the quaternary ammonium salt additives of the present invention are esters.

Preferred ester quaternising agents are compounds of formula (I):

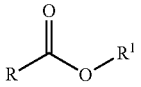

(I)

in which R is an optionally substituted alkyl, alkenyl, aryl or alkylaryl group and $R^1$ is a C1 to C22 alkyl, aryl or alkylaryl group. The compound of formula (I) is suitably an ester of a carboxylic acid capable of reacting with a tertiary amine to form a quaternary ammonium salt.

Suitable quaternising agents include esters of carboxylic acids having a pKa of 3.5 or less.

The compound of formula (I) is preferably an ester of a carboxylic acid selected from a substituted aromatic carboxylic acid, an α-hydroxycarboxylic acid and a polycarboxylic acid.

In some preferred embodiments the compound of formula (I) is an ester of a substituted aromatic carboxylic acid and thus R is a substituted aryl group.

Preferably R is a substituted aryl group having 6 to 10 carbon atoms, preferably a phenyl or naphthyl group, most preferably a phenyl group. R is suitably substituted with one or more groups selected from carboalkoxy, nitro, cyano, hydroxy, $SR^5$ or $NR^5R^6$. Each of $R^5$ and $R^6$ may be hydrogen or optionally substituted alkyl, alkenyl, aryl or carboalkoxy groups. Preferably each of $R^5$ and $R^6$ is hydrogen or an optionally substituted C1 to C22 alkyl group, preferably hydrogen or a C1 to C16 alkyl group, preferably hydrogen or a C1 to C10 alkyl group, more preferably hydrogen or a C1 to C4 alkyl group. Preferably $R^5$ is hydrogen and $R^6$ is hydrogen or a C1 to C4 alkyl group. Most preferably $R^5$ and $R^6$ are both hydrogen. Preferably R is an aryl group substituted with one or more groups selected from hydroxyl, carboalkoxy, nitro, cyano and $NH_2$. R may be a poly-substituted aryl group, for example trihydroxyphenyl. In some embodiments R may be a hydrocarbyl substituted aryl group, for example an alkyl substituted aryl group. In some embodiments R may be an aryl group substituted with a hydroxy group and a hydrocarbyl group, such as an alkyl group, for example as described in EP2631283.

Preferably R is a mono-substituted aryl group. Preferably R is an ortho substituted aryl group. Suitably R is substituted with a group selected from OH, $NH_2$, $NO_2$ or COOMe. Preferably R is substituted with an OH or $NH_2$ group. Suitably R is a hydroxy substituted aryl group. Most preferably R is a 2-hydroxyphenyl group.

Preferably $R^1$ is an alkyl, aralkyl or alkaryl group. $R^1$ may be a C1 to C16 alkyl group, preferably a C1 to C10 alkyl group, suitably a C1 to C8 alkyl group. $R^1$ may be C7 to C16 aralkyl or alkaryl group, preferably a C7 to C10 aralkyl or alkaryl group. $R^1$ may be methyl, ethyl, propyl, butyl, pentyl, benzyl or an isomer thereof. Preferably $R^1$ is benzyl or methyl. Most preferably $R^1$ is methyl.

Especially preferred compounds of formula (I) are lower alkyl esters of salicylic acid such as methyl salicylate, ethyl salicylate, n- and i-propyl salicylate, and butyl salicylate, preferably methyl salicylate.

In some embodiments the compound of formula (I) is an ester of an α-hydroxycarboxylic acid. In such embodiments the compound has the structure (Ia):

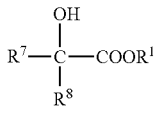

(Ia)

wherein $R_7$ and $R^8$ are the same or different and each is selected from hydrogen, alkyl, alkenyl, aralkyl or aryl. Compounds of this type suitable for use herein are described in EP1254889.

Examples of compounds of formula (I) in which RCOO is the residue of an α-hydroxycarboxylic acid include methyl-, ethyl-, propyl-, butyl-, pentyl-, hexyl-, benzyl-, phenyl-, and allyl esters of 2-hydroxyisobutyric acid; methyl-, ethyl-, propyl-, butyl-, pentyl-, hexyl-, benzyl-, phenyl-, and allyl esters of 2-hydroxy-2-methylbutyric acid; methyl-, ethyl-, propyl-, butyl-, pentyl-, hexyl-, benzyl-, phenyl-, and allyl esters of 2-hydroxy-2-ethylbutyric acid; methyl-, ethyl-, propyl-, butyl-, pentyl-, hexyl-, benzyl-, phenyl-, and allyl esters of lactic acid; and methyl-, ethyl-, propyl-, butyl-, pentyl-, hexyl-, allyl-, benzyl-, and phenyl esters of glycolic acid. Of the above, a preferred compound is methyl 2-hydroxyisobutyrate.

In some embodiments the compound of formula (I) is an ester of a polycarboxylic acid. In this definition we mean to include dicarboxylic acids and carboxylic acids having more than 2 acidic moieties. In such embodiments RCOO is preferably present in the form of an ester, that is the one or more further acid groups present in the group R are in esterified form. However embodiments in which not all acid groups are esterified are within the invention. Mixed esters of polycarboxylic acids may also be used. Preferred esters are C1 to C4 alkyl esters.

The ester quaternising agent may be selected from the diester of oxalic acid, the diester of phthalic acid, the diester of maleic acid, the diester of malonic acid or the diester of citric acid. One especially preferred compound of formula (I) is dimethyl oxalate.

In preferred embodiments the compound of formula (I) is an ester of a carboxylic acid having a pKa of less than 3.5. In such embodiments in which the compound includes more than one acid group, we mean to refer to the first dissociation constant.

The ester quaternising agent may be selected from an ester of a carboxylic acid selected from one or more of oxalic acid, phthalic acid, salicylic acid, maleic acid, malonic acid, citric acid, nitrobenzoic acid, aminobenzoic acid, 2,4,6-trihydroxybenzoic acid, succinic acid, glutaric acid, adipic acid, fumaric acid, acetylene dicarboxylic acid, glutaconic acid, muconic acid, citraconic acid, mesaconic acid, itaconic acid, tartronic acid, mesoxalic acid, tartaric acid, oxaloacetic acid, dioxosuccinic acid, alpha-hydroxyglutaric acid, diphenic acid and 2,6-naphthalenedicarboxylic acid.

The ester quaternising agent may be selected from an ester of a carboxylic acid selected from one or more of oxalic acid, phthalic acid, salicylic acid, maleic acid, malonic acid, citric acid, nitrobenzoic acid, aminobenzoic acid and 2,4,6-trihydroxybenzoic acid.

Preferred ester quaternising agents include dimethyl oxalate, methyl 2-nitrobenzoate and methyl salicylate.

In some preferred embodiments, quaternising agents used to form the quaternary ammonium salt additives of the present invention are esters selected from dimethyl oxalate, methyl 2-nitrobenzoate and methyl salicylate, preferably dimethyl oxalate and methyl salicylate.

Suitable non-ester quaternising agents include dialkyl sulfates, benzyl halides, hydrocarbyl substituted carbonates, hydrocarbyl substituted epoxides optionally in combination with an acid, alkyl halides, alkyl sulfonates, sultones, hydrocarbyl substituted phosphates, hydrocarbyl substituted borates, alkyl nitrites, alkyl nitrates, hydroxides, N-oxides, chloroacetic acid or salts thereof, or mixtures thereof.

Preferred non-ester quaternising agents include dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, N-oxides, chloroacetic acid or salts thereof, or mixtures thereof.

In some embodiments the quaternary ammonium salt may be prepared from, for example, an alkyl or benzyl halide (especially a chloride) and then subjected to an ion exchange reaction to provide a different anion as part of the quaternary ammonium salt. Such a method may be suitable to prepare quaternary ammonium hydroxides, alkoxides, nitrites or nitrates.

Suitable alkyl halides for use herein include chlorides, bromides and iodides.

Suitable benzyl halides include chlorides, bromides and iodides. The phenyl group may be optionally substituted, for example with one or more alkyl or alkenyl groups, especially when the chlorides are used. A preferred compound is benzyl bromide.

Suitable dialkyl sulfates for use herein as quaternising agents include those including alkyl groups having 1 to 10, preferably 1 to 4 carbons atoms in the alkyl chain. A preferred compound is dimethyl sulfate.

Suitable hydrocarbyl substituted carbonates may include two hydrocarbyl groups, which may be the same or different. Each hydrocarbyl group may contain from 1 to 50 carbon atoms, preferably from 1 to 20 carbon atoms, more preferably from 1 to 10 carbon atoms, suitably from 1 to 5 carbon atoms. Preferably the or each hydrocarbyl group is an alkyl group. Preferred compounds of this type include diethyl carbonate and dimethyl carbonate.

Suitable hydrocarbyl substituted epoxides have the formula (Ib):

(Ic)

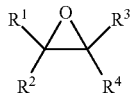

wherein each of $R^1$, $R^2$, $R^3$ and $R^4$ is independently hydrogen or a hydrocarbyl group having 1 to 50 carbon atoms. Examples of suitable epoxides include ethylene oxide, propylene oxide, butylene oxide, styrene oxide and stilbene oxide. The hydrocarbyl epoxides are used as quaternising agents in combination with an acid.

In some embodiments the compound including a tertiary amine group also includes an acid functional group. In these embodiments if an epoxide is used as the quaternising agent, a separate acid does not need to be added. However in other embodiments an acid, for example acetic acid, may be used.

Especially preferred epoxide quaternising agents are propylene oxide and styrene oxide, optionally in combination with an additional acid.

Suitable alkyl sulfonates include those having 1 to 20, preferably 1 to 10, more preferably 1 to 4 carbon atoms.

Suitable sultones include propane sultone and butane sultone.

Suitable hydrocarbyl substituted phosphates include monoalkyl phosphates, dialkyl phosphates, trialkyl phosphates and O,O-dialkyl dithiophospates. Preferred alkyl groups have 1 to 12 carbon atoms.

Suitable hydrocarbyl substituted borate groups include alkyl borates having 1 to 12 carbon atoms.

Preferred alkyl nitrites and alkyl nitrates have 1 to 12 carbon atoms.

Preferably the non-ester quaternising agent is selected from dialkyl sulfates, benzyl halides, hydrocarbyl substituted carbonates, hydrocarbyl substituted epoxides optionally in combination with an additional acid, chloroacetic acid or a salt thereof, and mixtures thereof.

Especially preferred non-ester quaternising agents for use herein are hydrocarbyl substituted epoxides in combination with an acid. These may include embodiments in which a separate acid is provided or embodiments in which the acid is provided by the tertiary amine compound that is being quaternised. Preferably the acid is provided by the tertiary amine molecule that is being quaternised.

Preferred quaternising agents for use herein include dimethyl oxalate, methyl 2-nitrobenzoate, methyl salicylate, chloroacetic acid or a salt thereof, and styrene oxide or propylene oxide optionally in combination with an additional acid.

In some embodiments mixtures of two or more quaternising agents may be used.

To form the quaternary ammonium salt additive the quaternising agent is reacted with a compound including a tertiary amine group.

Any suitable compound including a tertiary amine group may be used.

The compound including at least one tertiary amine group may be selected from:

(i) the reaction product of a hydrocarbyl-substituted acylating agent and a compound comprising at least one tertiary amine group and a primary amine, secondary amine or alcohol group;

(ii) a Mannich reaction product comprising a tertiary amine group;

(iii) a polyalkylene substituted amine having at least one tertiary amine group; and (iv) simple alkylamines and alkanolamines.

Examples of quaternary ammonium salt and methods for preparing the same are described in the following patents: US2008/0307698, US2008/0052985, US2008/0113890 and US2013/031827, which are incorporated herein by reference.

The preparation of some suitable quaternary ammonium salt additives in which the compound including at least one tertiary amine group includes component (i) is described in WO2006/135881, US2020/0024536 and WO2011/095819, which are incorporated herein by reference.

The preparation of quaternary ammonium salts in which the compound including at least one tertiary amine group includes component (ii) is described in US 2008/0052985, which is incorporated herein by reference.

The preparation of quaternary ammonium salt additives in which the compound including at least one tertiary amine group includes component (iii) is described for example in US2008/0113890, which is incorporated herein by reference.

The preparation of some suitable quaternary ammonium salt additives in which the compound including at least one tertiary amine group includes component (i) is described, for example in WO2016/016641, which is incorporated herein by reference.

Other suitable quaternary ammonium salts include quaternised terpolymers, for example as described in US2011/0258917; quaternised copolymers, for example as described in US2011/0315107; and the acid-free quaternised nitrogen compounds disclosed in US2012/0010112, which are incorporated herein by reference.

In preferred embodiments, the quaternary ammonium salts of additive (a) include a separate anion and a separate cation.

In some embodiments wherein the compound including at least one tertiary amine group is (i) the reaction product of a hydrocarbyl-substituted acylating agent and a compound comprising at least one tertiary amine group and a primary amine, secondary amine or alcohol group.

In such embodiments, additive (a) is one or more quaternised reaction product of (a1) a hydrocarbyl-substituted acylating agent and (a2) a compound comprising at least one tertiary amine group and a primary amine, secondary amine or alcohol group.

The hydrocarbyl-substituted acylating agent (a1) may be provided by a fatty acid. Suitable fatty acids are compounds of formula RCOOH in which R is an alkyl or alkenyl group having 6 to 36 carbon atoms, preferably 8 to 30 carbon atoms or 12 to 24 carbon atoms. One preferred fatty acid is oleic acid.

In such embodiments, the compound comprising at least one tertiary amine group and a primary amine, secondary amine or alcohol group (a2) is suitably provided by a compound of formula (II) or (III):

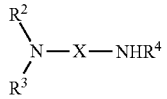

(II)

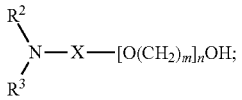

(III)

wherein $R^2$ and $R^3$ are the same or different alkyl, alkenyl, aryl, alkaryl or aralkyl groups having from 1 to 22 carbon atoms; X is a bond or an optionally substituted alkylene group having from 1 to 20 carbon atoms; n is from 0 to 20; m is from 1 to 5; and $R^4$ is hydrogen or a $C_1$ to $C_{22}$ alkyl group.

Suitable compounds according to formula (II) may be selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino) ethoxy) propylamine, or combinations thereof. In some preferred embodiments, compound (a2) is dimethylaminopropyl amine.

In such embodiments, additive (a) is suitably the quaternised reaction product of (a1) a fatty acid, for example of formula RCOOH in which R is an alkyl or alkenyl group having 12 to 24 carbon atoms, and (a2) a compound of formula (II), suitably wherein both $R^2$ and $R^3$ are $C_1$ to $C_4$ alkyl groups and X is alkylene group having from 2 to 5 carbon atoms.

In such embodiments, additive (a) is suitably the quaternised reaction product of (a1) a fatty acid (for example oleic acid) and (a2) dimethylaminopropyl amine. The term "quaternary ammonium compounds" is used herein interchangeably with "quaternary ammonium salt additive" and "quaternary ammonium salt". Therefore in such embodiments the quaternary ammonium compounds for use in the present invention are the quaternised reaction product of a fatty acid (for example oleic acid) and dimethylaminopropyl amine.

References herein to dimethylaminopropyl amine are intended to refer to N,N-dimethyl-1,3-diaminopropane (DMAPA).

In such embodiments, additive (a) is preferably the quaternised reaction product of (a1) oleic acid and (a2) dimethylaminopropyl amine.

In such embodiments, suitable quaternising agents for reaction with the reaction product described above are dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, N-oxides, chloroacetic acid or salts thereof, or mixtures thereof. Preferably the quaternising agent is chloroacetic acid or salts thereof, for example sodium chloroacetate.

In such embodiments, additive (a) may have the formula (IV):

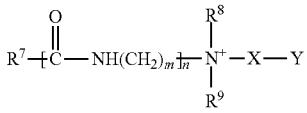

(IV)

wherein $R_7$ is alkyl or alkenyl of 7 to 22 carbon atoms; $R^8$ and $R^9$ are each independently alkyl, hydroxyalkyl or carboxyalkyl of 1 to 6 carbon atoms; m is 2 to 4; n is 0 or 1; X is alkylene of 1 to 6 carbon atoms optionally substituted with hydroxyl; and Y is $—CO_2^-$or $—SO_3^-$.

Preferably additive (a) is an amido betaine having the formula (V):

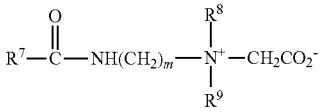

wherein $R^7$, $R^8$ and $R^9$ are as defined above and wherein m is 2 or 3.

Preferably $R^7$ has from 16 to 22 carbon atoms. $R^7$ is preferably an alkenyl group having from 16 to 22 carbon atoms. For example $R^7$ may be a $C_{17}$ alkenyl group derived from oleic acid. $R^8$ and $R^9$ are preferably methyl.

In one preferred embodiment, additive (a) is the quaternised reaction product of (a1) oleic acid and (a2) dimethylaminopropyl amine, wherein the reaction product has been quaternised with chloroacetic acid or salts thereof.

Further suitable quaternary ammonium salt additives for use in the present invention include the quaternary ammonium salt additives described in the applicant's copending applications WO2011/095819, WO2013/017889, WO2015/011506, WO2015/011507, WO2016/016641 and WO2017/017454, which are incorporated herein by reference.

In some embodiments wherein the compound including at least one tertiary amine group is (i) the reaction product of a hydrocarbyl-substituted acylating agent and a compound comprising at least one tertiary amine group and a primary amine, secondary amine or alcohol group, the hydrocarbyl-substituted acylating agent (a1) may be provided by a hydrocarbyl substituted succinic acid derived acylating agent.

In such embodiments, the quaternary ammonium salt additive (a) is the quaternised reaction product of (a1) a hydrocarbyl substituted succinic acid derived acylating agent and (a2) a compound comprising at least one tertiary amine group and a primary amine, secondary amine or alcohol group.

For the avoidance of doubt, reference to the quaternised reaction product is meant to refer to a reaction product which comprises the tertiary amine which has then been quaternised to form a quaternary ammonium group. The quaternary ammonium salt additive is formed by reacting a quaternising agent with the reaction product of a hydrocarbyl substituted succinic acid derived acylating agent and a compound able to react with said acylating agent and which includes a tertiary amine group.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon groups, that is, aliphatic (which may be saturated or unsaturated, linear or branched, e.g., alkyl or alkenyl), alicyclic (e.g., cycloalkyl, cycloalkenyl) substituents, and aromatic (including aliphatic- and alicyclic-substituted aromatic) substituents, as well as cyclic substituents wherein the ring is completed through another portion of the molecule (e.g., two substituents together form a ring);

(ii) substituted hydrocarbon groups, that is, substituents containing non-hydrocarbon groups which, in the context of this invention, do not alter the predominantly hydrocarbon nature of the substituent (e.g., halo (e.g. chloro, fluoro or bromo), hydroxy, alkoxy (e.g. $C_1$ to $C_4$ alkoxy), keto, acyl, cyano, mercapto, amino, amido, nitro, nitroso, sulfoxy, nitryl and carboxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Suitable hydrocarbyl substituted succinic acid derived acylating agents and means of preparing them are well known in the art. For example a common method of preparing a hydrocarbyl substituted succinic acylating agent is by the reaction of maleic anhydride with an olefin using a chlorination route or a thermal route (the so-called "ene" reaction).

Illustrative of hydrocarbyl substituent based groups include n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. Alternatively the substituent may be made from other sources, for example monomeric high molecular weight alkenes (e.g. 1-tetra-contene), aliphatic petroleum fractions, for example paraffin waxes and cracked analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

Preferably the hydrocarbyl substituents are predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

The hydrocarbyl substituent of the succinic acid derived acylating agent preferably comprises at least 10, more preferably at least 12, for example at least 30 or at least 40 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred.

The skilled person would be familiar with standard techniques to measure number average molecular weight, such as by vapor pressure osmometry, end-group titration, proton NMR, boiling point elevation, freezing depression (cryoscopy), and GPC (gel permeation chromatography).

The hydrocarbyl substituted succinic acid derived acylating agent may comprise a mixture of compounds. For example a mixture of compounds having different hydrocarbyl substituents may be used.

Preferred hydrocarbyl-based substituents are polyisobutenes. Such compounds are known to the person skilled in the art.

Preferred hydrocarbyl substituted succinic acid derived acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285, which is incorporated herein by reference. Particularly preferred polyisobutenes are those having more than 80 mol % and up to 100 mol % of terminal vinylidene groups such as those described in U.S. Pat. No. 7,291,758, which is incorporated herein by reference. Preferred polyisobutenes have preferred molecular weight (Mn) ranges as described above for hydrocarbyl substituents generally.

Other preferred hydrocarbyl groups include those having an internal olefin for example as described in the applicant's published application WO2007/015080, which is incorporated herein by reference.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 15181O available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Preferred hydrocarbyl substituted succinic acid derived acylating agents (a1) for use in preparing additive (a) are polyisobutenyl substituted succinic anhydrides or PIBSAs. Especially preferred PIBSAs are those having a PIB molecular weight (Mn) of from 300 to 2800, preferably from 450 to 2300, more preferably from 500 to 1300 or from 700 to 1300.

Preferably (a1) is a polyisobutenyl substituted succinic anhydride having a PIB molecular weight (Mn) of from 700 to 1300.

The hydrocarbyl substituted succinic acid derived acylating agent is suitably prepared by reacting maleic anhydride with an alkene, for example a polyisobutene. The product obtained (such as a PIBSA) still includes a double bond. The maleic anhydride is present in the resultant molecule as a succinic acid moiety. This initial product is a monomaleated PIBSA.

The monomaleated PIBSA may have the structure (A) or (B):

(A)

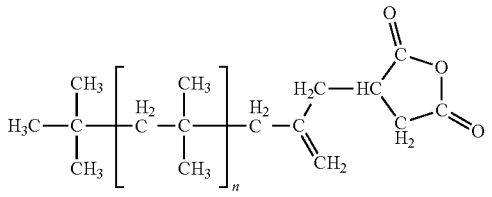

(B)

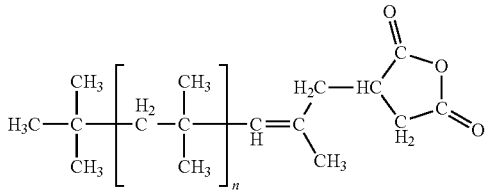

The double bond in the monomaleated product can react with a further molecule of maleic anhydride to form a bismaleated PIBSA having the structure (C) or (D):

(C)

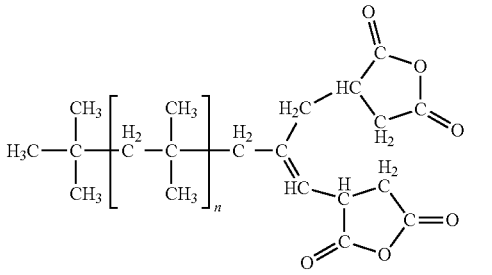

(D)

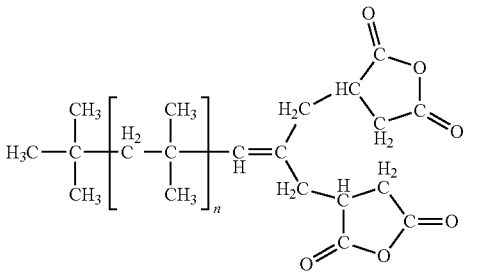

Thus it is possible to provide a hydrocarbyl group which is substituted with more than one succinic acid moiety.

The skilled person will appreciate that the additives used in the invention typically comprise mixtures of compounds and will be prepared from a mixture of monomaleated and bismaleated PIBSAs. The PIBSAs may be defined in terms of their level of bismaleation.

One way in which this may be determined is by calculating the average number of succinic acid moieties per molecule of acylating agent.

A monomaleated PIBSA has one succinic acid moiety per module.

A bismaleated PIBSA has two succinic acid moieties per molecule.

A mixture comprising monomaleated PIBSA and bismaleated PIBSA in a 1:1 molar ratio would comprise an average of 1.5 succinic acid moieties per molecule of PIBSA.

The average number of succinic acid moieties per molecule of acylating agent is sometimes referred to in the art as "P value".

Suitably the quaternary ammonium salt additive (a) is prepared from (a1) a hydrocarbyl substituted succinic acid derived acylating agent comprising on average from 1 to 2 succinic acid moieties per molecule.

In some preferred embodiments the present invention may involve the use of quaternary ammonium salts derived from hydrocarbyl substituted acylating agents which include an average of at least 1.2 succinic acid moieties per molecule.

As the skilled person will appreciate, a single molecule cannot have 1.2 succinic acid moieties. What is meant by at least 1.2 succinic acid moieties is the mean number of succinic acid moieties per molecule of acylating agent as the sum of all the succinic acid moieties present in a sample divided by the total number of molecules of acylating agent having one or more succinic acid moieties present in the sample.

Preferably the hydrocarbyl substituted succinic acid derived acylating agent comprises on average at least 1.21 succinic acid moieties per molecule, more preferably at least 1.22 succinic acid moieties per molecule.

In some embodiments the hydrocarbyl substituted succinic acid derived acylating agent may comprise at least 1.23 or at least 1.24 succinic acid moieties per molecule.

In some embodiments the hydrocarbyl substituted succinic acid derived acylating agent may comprise at least 1.25, at least 1.26 or at least 1.27 succinic acid moieties per molecule.

In some embodiments the hydrocarbyl substituted succinic acid derived acylating agent may comprise at least 1.28, at least 1.29 or at least 1.30 succinic acid moieties per molecule.

By succinic acid moiety we mean to include residues of succinic acid present in diacid or anhydride form.

In such embodiments, the hydrocarbyl substituted succinic acid derived acylating agent (a1) is reacted with (a2) a compound comprising at least one tertiary amine group and a primary amine, secondary amine or alcohol group. The tertiary amine group is then quaternised to provide the quaternary ammonium salt (a).

Components (a2) may be selected from: N,N-dimethylaminopropylamine, N,N-diethylaminopropylamine, N,N-dimethylamino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl) morpholine, 1-(2-aminoethyl)piperidine, 3,3-diamino-N-methyldipropylamine, and 3'3-aminobis(N,N-dimethylpropylamine). Suitably component (a2) is selected from alkanolamines including but not limited to triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl)amine, N,N,N-tris(aminoethyl)amine, N,N-dibutylaminopropylamine and N,N,N'-trimethyl-N'-hydroxyethyl-bisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy)ethanol, N,N,N'-trimethylaminoethylethanolamine and 3-(2-(dimethylamino) ethoxy) propylamine.

Preferably component (a2) is an amine of formula (II) or (III):

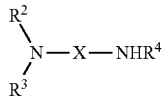

(II)

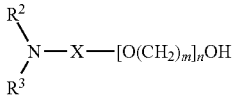

(III)

wherein $R^2$ and $R^3$ are the same or different alkyl, alkenyl, aryl, alkaryl or aralkyl groups having from 1 to 22 carbon atoms; X is a bond or an optionally substituted alkylene group having from 1 to 20 carbon atoms; n is from 0 to 20; m is from 1 to 5; and $R^4$ is hydrogen or a $C_1$ to $C_{22}$ alkyl group.

When a compound of formula (II) is used, $R^4$ is preferably hydrogen or a $C_1$ to $C_{16}$ alkyl group, preferably a $C_1$ to $C_{10}$ alkyl group, more preferably a $C_1$ to $C_6$ alkyl group. When $R^4$ is alkyl it may be straight chained or branched. It may be substituted for example with a hydroxy or alkoxy substituent. Preferably $R^4$ is not a substituted alkyl group. More preferably $R^4$ is selected from hydrogen, methyl, ethyl, propyl, butyl and isomers thereof. Most preferably $R^4$ is hydrogen.

When a compound of formula (III) is used, m is preferably 2 or 3, most preferably 2; n is preferably from 0 to 15, preferably 0 to 10, more preferably from 0 to 5. Most preferably n is 0 and the compound of formula (III) is an alcohol.

Preferably (a2) is a diamine compound of formula (II).

$R^2$ and $R^3$ are the same or different alkyl, alkenyl, aryl, alkaryl or aralkyl groups having from 1 to 22 carbon atoms. In some embodiments $R^2$ and $R^3$ may be joined together to form a ring structure, for example a piperidine, imidazole or morpholine moiety. Thus $R^2$ and $R^3$ may together form an aromatic and/or heterocyclic moiety. $R^2$ and $R^3$ may be branched alkyl or alkenyl groups. Each may be substituted, for example with a hydroxy or alkoxy substituent.

Preferably each of $R^2$ and $R^3$ is independently a $C_1$ to $C_{16}$ alkyl group, preferably a C to $C_{10}$ alkyl group. $R^2$ and $R^3$ may independently be methyl, ethyl, propyl, butyl, pentyl, hexyl, heptyl, octyl, or an isomer of any of these. Preferably $R^2$ and $R^3$ is each independently $C_1$ to $C_4$ alkyl. Preferably $R^2$ is methyl. Preferably $R^3$ is methyl.

X is a bond or an optionally substituted alkylene group having from 1 to 20 carbon atoms. In preferred embodiments when X is an alkylene group this group may be straight chained or branched. The alkylene group may include a cyclic structure therein. It may be optionally substituted, for example with a hydroxy or alkoxy substituent. In some embodiments X may include a heteroatom within the alkylene chain, for example X may include an ether functionality.

X is preferably an alkylene group having 1 to 16 carbon atoms, preferably 1 to 12 carbon atoms, more preferably 1 to 8 carbon atoms, for example 2 to 6 carbon atoms or 2 to 5 carbon atoms. In some preferred embodiments X is an unsubstituted alkylene group. Most preferably X is an ethylene, propylene or butylene group, especially a propylene group.

Examples of compounds of formula (II) suitable for use herein include 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), 1-(3-aminopropyl) imidazole and 4-(3-aminopropyl)morpholine, 1-(2-aminoethyl)piperidine, 3,3-diamino-N-methyldipropylamine, 3,3-aminobis(N,N-dimethylpropylamine), 3-(2-(dimethylamino)ethoxy) propylamine, or combinations thereof.

In some preferred embodiments the compound of formula (II) is selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof.

An especially preferred compound of formula (II) is N,N-dimethyl-1,3-diaminopropane (dimethylaminopropylamine).

Examples of compounds of formula (III) suitable for use herein include alkanolamines including but not limited to triethanolamine, N,N-dimethylaminopropanol, N,N-diethylaminopropanol, N,N-diethylaminobutanol, triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethyl amino-ethanol, 2-dimethylamino-2-methyl-1-propanol, N,N,N'-trimethyl-N'-hydroxyethyl-bisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy)ethanol, and N,N,N'-trimethylaminoethylethanolamine.

In some preferred embodiments the compound of formula (III) is selected from Triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, or combinations thereof.

When a compound of formula (III) is reacted with a succinic acylating agent the resulting product is a succinic ester. When a succinic acylating agent is reacted with a compound of formula (II) in which $R^4$ is hydrogen the resulting product may be a succinimide or a succinamide. When a succinic acylating agent is reacted with a compound of formula (II) in which $R^4$ is not hydrogen the resulting product is an amide.

In some embodiments wherein the succinic acylating agent is reacted with a compound comprising a primary amine moiety, for example a compound of formula (II) in which $R^4$ is hydrogen, the reaction may form an amide bond, an imide bond or a mixture thereof. Therefore the reaction product may be a succinimide or a succinamide, or a mixture thereof. Whether a succinimide or a succinamide is formed may depend on the reaction conditions used. The skilled person would be able to select appropriate reaction conditions for forming predominantly the succinimide form or predominantly the succinamide form of the reaction product. The succinamide suitably comprises a free carboxylic acid moiety and an amide bond formed between the succinic acylating agent and the amine compound.

In some preferred embodiments, the quaternary ammonium salt additive (a) is the quaternised reaction product of (a1) a hydrocarbyl substituted succinic acid derived acylating agent and (a2) a compound comprising at least one tertiary amine group and a primary amine, secondary amine or alcohol group is a succinimide, preferably a polyisobutenyl succinimide (known as a "PIBSI").

In some preferred embodiments, the quaternary ammonium salt additive (a) is the quaternised reaction product of (a1) a hydrocarbyl substituted succinic acid derived acylating agent and (a2) a compound comprising at least one tertiary amine group and a primary amine, secondary amine or alcohol group is a succinamide, preferably a polyisobutenyl succinamide.

To form the quaternary ammonium salt additive (a) the reaction product of (a1) and (a2) is then quaternised by reaction with a quaternising agent.

The reaction product of (a1) and (a2) is preferably reacted with at least one molar equivalent of quaternising agent per mole of tertiary amine group present in the reaction product.

In some embodiments the reaction product of (a1) and (a2) may be reacted with more than one molar equivalent of quaternising agent per mole of tertiary amine group present in the reaction product, preferably at least 1.2 molar equivalents of quaternising agent per mole of tertiary amine group, more preferably at least 1.5 molar equivalents of quaternising agent, suitably at least 1.7 molar equivalents of quaternising agent, for example at least 1.9 molar equivalents of quaternising agent.

In some embodiments the reaction product of (a1) and (a2) may be reacted with two or more molar equivalents of quaternising agent per mole of tertiary amine group present in the reaction product, preferably at least 2.1 molar equivalents of quaternising agent.

In some embodiments the reaction product of (a1) and (a2) is reacted with more than 2.2 molar equivalents of quaternising agent per mole of tertiary amine group present in the reaction product, for example from 2.3 to 4 molar equivalents, from 2.3 to 3 molar equivalents, or from 2.3 to 2.7 or from 2.5 to 3 molar equivalents.

To form some preferred quaternary ammonium salts (a) of the present invention the compound of formula (I) is reacted with a compound formed by the reaction of (a1) a hydrocarbyl substituted acylating agent and (a2) an amine of formula (II) or (III).

The compounds of formula (II) or formula (III) are as described above.

In some preferred embodiments, (a1) is a hydrocarbyl substituted succinic acid derived acylating agent such as a succinic acid or succinic anhydride and (a2) is an amine of formula (II) or (III).

Suitably approximately one equivalent of (a2) amine is added per succinic acid moiety present in the acylating agent (a1). The ratio of amine used will thus typically depend on the average number of succinic acid moieties present in each molecule of the acylating agent.

In preferred embodiments, (a1) is a polyisobutylene-substituted succinic anhydride having a PIB molecular weight (Mn) of 700 to 1300.

In preferred embodiments, (a2) is an amine of formula (II), suitably selected from N,N-dimethylaminopropylamine, N,N-diethylaminopropylamine or N,N-dimethylamino ethylamine.

In some preferred embodiments, additive (a) is one or more quaternised reaction product of (a1) a polyisobutylene-substituted succinic anhydride having a PIB molecular weight (Mn) of 700 to 1300 and (a2) an amine of formula (II), suitably selected from N,N-dimethylaminopropylamine, N,N-diethylaminopropylamine or N,N-dimethylamino ethylamine.

Preferred quaternary ammonium salts (a) for use herein may be formed by reacting methyl salicylate, dimethyl oxalate or propylene oxide optionally in combination with an acid with the reaction product of (a1) a polyisobutylene-substituted succinic anhydride having a PIB molecular weight (Mn) of 700 to 1300 and (a2) dimethylaminopropylamine. Additive (a) may be a mixture of two or more such quaternary ammonium salts.

An especially preferred quaternary ammonium salt (a) for use herein is formed by reacting methyl salicylate or dimethyl oxalate with the reaction product of (a1) a polyisobutylene-substituted succinic anhydride having a PIB molecular weight (Mn) of 700 to 1300 and (a2) dimethylaminopropylamine.

In one preferred embodiment the polyisobutylene-substituted succinic anhydride (a1) includes on average at least 1.2 succinic acid moieties per molecule.

In some preferred embodiments, the quaternary ammonium salt (a) is formed by reacting a quaternising agent with the reaction product of (a1) a polyisobutylene-substituted succinic anhydride having a PIB molecular weight (Mn) of 700 to 1300 and (a2) dimethylaminopropylamine, wherein the reaction product of (a1) and (a2) is predominantly in the succinimide form. Preferably the quaternising agent is an alkylene oxide (preferably propylene oxide), optionally in combination with an acid, chloroacetic acid or a salt thereof, methyl salicylate or dimethyl oxalate. In some preferred embodiments, the quaternising agent is methyl salicylate.

In some preferred embodiments, the quaternary ammonium salt (a) is formed by reacting a quaternising agent with the reaction product of (a1) a polyisobutylene-substituted succinic anhydride having a PIB molecular weight (Mn) of 700 to 1300 and (a2) dimethylaminopropylamine, wherein the reaction product of (a1) and (a2) is predominantly in the succinamide form. Preferably the quaternising agent is an alkylene oxide (preferably propylene oxide), optionally in combination with an acid, chloroacetic acid or a salt thereof, methyl salicylate or dimethyl oxalate. In some preferred embodiments, the quaternising agent is propylene oxide.

In some embodiments, the quaternary ammonium salt (a) is the reaction product of a quaternising agent and a compound including a tertiary amine group which is selected from (iv) simple alkylamines and alkanolamines.

In such embodiments, the compound including a tertiary amine group (iv) is a tertiary amine of formula $R^5R^6R^7N$, wherein each of $R^5$, $R^6$ and $R^7$ is independently an optionally substituted alkyl, alkenyl, aryl, alkaryl or aralkyl group.

The tertiary amine of formula $R^5R^6R^7N$ may be a small compound of low complexity and low molecular weight. In some embodiments the tertiary amine may be a complex molecule and/or a molecule of high molecular weight which includes a tertiary amine group.

The tertiary amine compounds of formula $R^5R^6R^7N$ preferably do not include any primary or secondary amine groups. In some embodiments they may be derived from compounds including these groups but preferably these have been subsequently reacted to form additional tertiary amine species. The tertiary amine compound of formula $R^5R^6R^7N$ may contain more than one tertiary amine group. However tertiary amine compounds including primary or secondary amine groups are within the scope of the invention provided these groups do not prevent quaternisation of the tertiary amine species.

In some embodiment of the compounds of formula $R^5R^6R^7N$, each of $R^5$, $R^6$ and $R^7$ is independently an optionally substituted alkyl, alkenyl, aryl, aralkyl or alkaryl group.

$R^5$, $R^6$ and $R^7$ may be the same or different. In some preferred embodiments $R^5$ and $R^6$ are the same and $R^7$ is different.

Preferably each of $R^5$ and $R^6$ is independently an optionally substituted alkyl, alkenyl, aryl, aralkyl or alkaryl group having from 1 to 50 carbon atoms, preferably from 1 to 40 carbon atoms, more preferably from 1 to 30 carbon atoms.

Each of $R^5$ and $R^6$ may be optionally substituted with one or more groups selected from halo (especially chloro and fluoro), hydroxy, alkoxy, keto, acyl, cyano, mercapto, alkylmercapto, dialkylamino, nitro, nitroso, and sulphoxy. The alkyl groups of these substituents may be further substituted.

Preferably each of $R^5$ and $R^6$ is independently an optionally substituted alkyl or alkenyl group. Preferably each of $R^5$ and $R^6$ is independently an optionally substituted alkyl group. In some embodiments each of $R^5$ and $R^6$ is independently an optionally substituted alkyl or alkenyl group having from 1 to 50 carbon atoms, preferably from 1 to 40 carbon atoms, more preferably from 1 to 30 carbon atoms, suitably from 1 to 20 carbon atoms, preferably from 1 to 12 carbon atoms, more preferably from 1 to 10 carbon atoms, suitably from 1 to 8 carbon atoms, for example from 1 to 6 carbon atoms.

In some preferred embodiments $R^5$ is an optionally substituted alkyl or alkenyl group, preferably having from 1 to 10, preferably from 1 to 4 carbon atoms. Preferably $R^5$ is an alkyl group. It may be a substituted alkyl group, for example a hydroxy substituted alkyl group. Preferably $R^5$ is an unsubstituted alkyl group. The alkyl chain may be straight-chained or branched. Preferably $R^5$ is selected from methyl, ethyl, propyl and butyl, including isomers thereof. Most preferably $R^5$ is methyl.

In some preferred embodiments $R^6$ is an optionally substituted alkyl or alkenyl group, preferably having from 1 to 10, preferably from 1 to 4 carbon atoms. Preferably $R^6$ is an alkyl group. It may be a substituted alkyl group, for example a hydroxy substituted alkyl group. Preferably $R^6$ is an unsubstituted alkyl group. The alkyl chain may be straight-chained or branched. Preferably $R^6$ is selected from methyl, ethyl, propyl and butyl, including isomers thereof. Most preferably $R^6$ is methyl.

In some embodiments $R^7$ is an optionally substituted alkyl or alkenyl group having from 1 to 50 carbon atoms, preferably from 1 to 40 carbon atoms, more preferably from 1 to 30 carbon atoms, suitably from 1 to 20 carbon atoms, preferably from 1 to 12 carbon atoms, more preferably from 1 to 10 carbon atoms, suitably from 1 to 8 carbon atoms, for example from 1 to 6 carbon atoms. Suitable substituents include halo (especially chloro and fluoro), hydroxy, alkoxy, keto, acyl, cyano, mercapto, alkylmercapto, amino, alkylamino, nitro, nitroso, sulphoxy, amido, alkyamido, imido and alkylimido. The alkyl groups of these substituents may be further substituted.

In some embodiments $R^7$ is an optionally substituted alkyl or alkenyl group, preferably having from 1 to 10, preferably from 1 to 4 carbon atoms. Suitably $R^7$ is an optionally substituted alkyl group. Preferably $R^7$ is a substituted alkyl group. Preferred substituents include alkoxy and hydroxyl groups.

In some preferred embodiments $R^7$ is a hydroxyl-substituted alkyl group. The alkyl chain may be straight-chained or branched. Most preferably $R^7$ is a hydroxyethyl group.

Suitable tertiary amine compounds of formula $R^5R^6R^7N$ include simple alkylamino and hydroxyalkylamino compounds; trialkylamino compounds having a high molecular weight substituent; Mannich reaction products including a tertiary amine and substituted acylated amines or alcohols including a tertiary amine.

Simple alkylamino and hydroxyalkyl amino compounds are preferably compounds of formula $R^5R^6R^7N$, wherein each of $R^5$, $R^6$ and $R^7$ is an alkyl group or a hydroxyalkyl group. Each of $R^5$, $R^6$ and $R^7$ may be the same or different. In some embodiments each of $R^5$, $R^6$ and $R^7$ is independently selected from an alkyl or hydroxyalkyl group having 1 to 10, preferably 1 to 6 carbon atoms, for example 1 to 4 carbon atoms. Each of $R^5$, $R^6$ and $R^7$ may be independently selected from methyl, ethyl, propyl, butyl, pentyl, hexyl, hydroxymethyl, hydroxyethyl, hydroxypropyl, hydroxybutyl, hydroxypentyl and hydroxyhexyl. The amine of formula $R^5R^6R^7N$ may be a trialkylamine, a dialkylhydroxyalkylamine, a dihydroxyalkylalkylamine or a trihydroxyalkylamine. There are many different compounds of this type and these will be known to the person skilled in the art.

In some embodiments one or two of the groups $R^5$, $R^6$ and $R^7$ is a short chain alkyl group having 1 to 6, preferably 1 to 4 carbon atoms and the other one or two groups is a longer chain alkyl or group having 6 to 30, preferably 10 to 24 carbon atoms.

In some embodiments each of $R^5$ and $R^6$ is $C_1$ to $C_4$ alkyl, preferably methyl and $R^7$ is an alkyl or alkenyl group having 6 to 36, preferably 10 to 30, for example 12 to 24 carbon atoms.

Compounds of this type include, for example, dimethyloctadecylamine and hexadecyl dimethyl amine.

In order to provide some embodiments the quaternary ammonium salt (a), the hexadecyl dimethyl amine may be quaternised by reaction with propylene oxide (for example 1 to 3 molar equivalent of propylene oxide) and polyisobutylene succinic acid (for example 1 molar equivalent of polyisobutylene succinic acid).

For example in some embodiments $R^5$ is $C_1$ to $C_4$ alkyl, preferably methyl and each $R^6$ and $R^7$ is an alkyl or alkenyl having 6 to 36, preferably 8 to 30, for example 10 to 24 carbon atoms.

Compounds of this type include, for example, hexadecyl dimethyl amine, N-methyl N-N-ditallowamine and dicocomethyl amine.

Especially preferred tertiary amine compounds of formula $R^5R^6R^7N$ include N,N-dimethyl ethanolamine, dimethyloctadecylamine and N-methyl N-N-ditallowamine.

In some preferred embodiments, the quaternary ammonium salt (a) is the reaction product of a compound including a tertiary amine group and a quaternising agent, wherein the compound including a tertiary amine group is selected from one or more of:

(i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;

(i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms; and (iv-a) a tertiary amine of formula $R^5R^6R^7N$, wherein each of $R^5$, $R^6$ and $R^7$ is independently an alkyl group or a hydroxyalkyl group.

The quaternising agent is preferably selected from alkylene oxide (preferably propylene oxide), optionally in combination with an acid, chloroacetic acid or a salt thereof, methyl salicylate or dimethyl oxalate.

In some preferred embodiments, the quaternary ammonium salt additive (a) is the reaction product of a compound including a tertiary amine group and a quaternising agent, wherein the compound including a tertiary amine group is selected from one or more of:

(i-a) the reaction product of a fatty acid of formula RCOOH in which R is an alkyl or alkenyl group having 12 to 24 carbon atoms, and a compound selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof;

(i-b) the reaction product of a hydrocarbyl substituted succinic acid derived acylating agent and a compound selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof; and (iv-a) a tertiary amine of formula $R^5R^6R^7N$, wherein each of $R^5$, $R^6$ and $R^7$ is independently an alkyl group or a hydroxyalkyl group.

In some preferred embodiments, the quaternary ammonium salt (a) is the reaction product of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is selected from one or more of:

(i-a) the reaction product of a fatty acid of formula RCOOH in which R is an alkyl or alkenyl group having 12 to 24 carbon atoms, and a compound selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof;

(i-b) the reaction product of a hydrocarbyl substituted succinic acid derived acylating agent and a compound selected from N,N-dimethyl-1,3-diaminopropane, N,N-diethyl-1,3-diaminopropane, N,N-dimethylethylenediamine, N,N-diethylethylenediamnine, N,N-dibutylethylenediamine, 3-(2- (dimethylamino)ethoxy) propylamine, or combinations thereof; and (iv-a) a tertiary amine of formula $R^5R^6R^7N$, wherein each of $R^5$, $R^6$ and $R^7$ is independently an alkyl group or a hydroxyalkyl group.

In some especially preferred embodiments, the quaternary ammonium salt additive (a) is the reaction product of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is selected from one or more of:

(i-a) the reaction product of a fatty acid of formula RCOOH in which R is an alkyl or alkenyl group having 12 to 24 carbon atoms, and N,N-dimethyl-1,3-diaminopropane (DMAPA);

(i-b) the reaction product of a polyisobutylene-substituted succinic anhydride having a PIB molecular weight (Mn) of 700 to 1300 and N,N-dimethyl-1,3-diaminopropane; and (iv-a) a tertiary amine of formula $R^5R^6R^7N$, wherein each of $R^5$ and $R^6$ is $C_1$ to $C_4$ alkyl, preferably methyl, and $R^7$ is an alkyl or alkenyl group having 12 to 24 carbon atoms.

(b) The Product of a Mannich Reaction Between an Aldehyde, an Amine and an Optionally Substituted Phenol The present invention involves the use of additive (b) one or more compounds which are a product of a Mannich reaction between (b1) an aldehyde, (b2) an amine and (b3) an optionally substituted phenol.

Additive (b) may be referred to herein as a Mannich additive. Preferably the aldehyde component (b1) used to prepare the Mannich additive is an aliphatic aldehyde. Preferably the aldehyde (b1) has 1 to 10 carbon atoms. Preferably (b1) is a C1-10 aliphatic aldehyde, suitably a C1-6 aliphatic aldehyde or a C1-3 aliphatic aldehyde. Most preferably (b1) is formaldehyde.

The amine component (b2) used to prepare the Mannich additive may be any suitable compound comprising at least one NH group. The amine component (b2) may be a polyamine compound. Suitable amines include primary or secondary monoamines having hydrocarbon substituents of 1 to 30 carbon atoms or hydroxyl-substituted hydrocarbon substituents comprising 1 to 30 carbon atoms. One suitable monoamine is butylamine.

In some embodiments the amine component (b2) is a polyamine. The polyamine may be straight chained or branched, and may include cyclic structures. Suitable polyamines may be selected from any compound including two or more amino groups. Preferably the polyamine is a (poly)alkylene polyamine (by which is meant an alkylene polyamine or a polyalkylene polyamine; including in each case a diamine, within the meaning of "polyamine"). Preferably the polyamine is a (poly)alkylene polyamine in which the alkylene component has 1 to 6, preferably 1 to 4, most preferably 2 to 3 carbon atoms. Most preferably the polyamine is a (poly) ethylene polyamine (that is, an ethylene polyamine or a polyethylene polyamine).

Preferably the polyamine has 2 to 15 nitrogen atoms, preferably 2 to 10 nitrogen atoms, more preferably 2 to 8 nitrogen atoms.

Preferably the polyamine includes the moiety $R^1R^2NCHR^3CHR^4NR^5R^6$ wherein each of $R^1$, $R^2$ $R^3$, $R^4$, $R^5$ and $R^6$ is independently selected from hydrogen, and an optionally substituted alkyl, alkenyl, alkynyl, aryl, alkylaryl or arylalkyl substituent. Therefore (b2) may be an optionally substituted ethylene diamine residue.

Preferably at least one of $R^1$ and $R^2$ is hydrogen. Preferably both of $R^1$ and $R^2$ are hydrogen.

Preferably at least two of $R^1$, $R^2$, $R^5$ and $R^6$ are hydrogen.

Preferably at least one of $R^3$ and $R^4$ is hydrogen. In some preferred embodiments each of $R^3$ and $R^4$ is hydrogen. In some embodiments $R^3$ is hydrogen and $R^4$ is alkyl, for example $C_1$ to $C_4$ alkyl, suitably methyl.

Preferably at least one of $R^5$ and $R^6$ is an optionally substituted alkyl, alkenyl, alkynyl, aryl, alkylaryl or arylalkyl substituent.

In embodiments in which at least one of $R^1$, $R^2$, $R^3$, $R^4$, $R^5$ and $R^6$ is not hydrogen, each is independently selected from an optionally substituted alkyl, alkenyl, alkynyl, aryl, alkylaryl or arylalkyl moiety. Preferably each is independently selected from hydrogen and an optionally substituted C(1-6) alkyl moiety.

In particularly preferred compounds each of $R^1$, $R^2$, $R^3$, $R^4$ and $R^5$ is hydrogen and $R^6$ is an optionally substituted alkyl, alkenyl, alkynyl, aryl, alkylaryl or arylalkyl substituent. Preferably $R^6$ is an optionally substituted C(1-6) alkyl moiety.

Such an alkyl moiety may be substituted with one or more groups selected from hydroxyl, amino (especially unsubstituted amino; —NH—, —$NH_2$), sulpho, sulphoxy, C(1-4) alkoxy, nitro, halo (especially chloro or fluoro) and mercapto.

There may be one or more heteroatoms incorporated into the alkyl chain, for example O, N or S, to provide an ether, amine or thioether.

Especially preferred substituents $R^1$, $R^2$, $R^3$, $R^4$, $R^5$ or $R^6$ are hydroxy-C(1-4)alkyl and amino-(C(1-4)alkyl, especially HO—$CH_2$—$CH_2$— and $H_2N$—$CH_2$—$CH_2$—.

Suitably the polyamine includes only amine functionality, or amine and alcohol functionalities.

The polyamine may be selected from ethylenediamine, diethylenetriamine, triethylenetetramine, tetraethylenepentamine, pentaethylene-hexamine, hexaethyleneheptamine, heptaethyleneoctamine, propane-1,2-diamine, 2(2-aminoethylamino)ethanol, and N',N'-bis(2-aminoethyl)ethylenediamine ($N(CH_2CH_2NH_2)_3$). Suitably the polyamine of (b2) is selected from ethylenediamine, diethylenetriamine, triethylenetetramine, tetraethylenepentamine, pentaethylene-hexamine, hexaethyleneheptamine and heptaethyleneoctamine. Most preferably the polyamine comprises tetraethylenepentamine or ethylenediamine.

Commercially available sources of polyamines typically contain mixtures of isomers and/or oligomers, and products prepared from these commercially available mixtures fall within the scope of the present invention.

Component (b3) used to prepare the Mannich additives is an optionally substituted phenol. The optionally substituted phenol of component (b3) may be substituted with 1 to 4 groups on the aromatic ring (in addition to the phenol OH). For example it may be a tri- or di-substituted phenol. Most preferably component (b3) is a mono-substituted phenol. Substitution may be at the ortho, and/or meta, and/or para position(s). Preferably the phenol is para-substituted.

The phenol may be substituted with any suitable group, for example one or more of an alkyl group, an alkenyl group, an alkynl group, a nitryl group, a carboxylic acid, an ester, an ether, an alkoxy group, a halo group, a further hydroxyl group, a mercapto group, an alkyl mercapto group, an alkyl sulphoxy group, a sulphoxy group, an aryl group, an arylalkyl group, a substituted or unsubstituted amine group or a nitro group.

In some embodiments, the phenol (b3) is substituted with a hydrocarbyl group, suitably at the para position. The hydrocarbyl group may be optionally substituted with, for example, hydroxyl, halo, (especially chloro and fluoro), alkoxy, alkyl, mercapto, alkyl sulphoxy, aryl or amino residues. Preferably the hydrocarbyl group consists essentially of carbon and hydrogen atoms. The phenol is suitably substituted with a hydrocarbyl group which is predominantly saturated, i.e. the hydrocarbyl group contains no more than one carbon-to-carbon unsaturated bond for every ten carbon-to-carbon single bonds present. Most preferably they contain no more than one carbon-to-carbon unsaturated bond for every 50 carbon-to-carbon bonds present.

Suitably the hydrocarbyl group is an alkyl group. Therefore component (b3) is suitably a monoalkyl phenol, suitably a para-substituted monoalkyl phenol. Suitably the alkyl group of the monoalkyl phenol has 4 to 28 carbon atoms, suitably 10 to 14 carbon atoms. The alkyl group may be linear or branched, suitably linear, having said number of carbon atoms.

In some preferred embodiments, (b3) is dodecyl phenol, suitably para-dodecyl phenol.

Other preferred hydrocarbyl substituents are polyalkenyl substituents. Such polyisobutenyl substituents having a number average molecular weight of from 400 to 2500, for example from 500 to 1500.

In some embodiments, the hydrocarbyl group of the phenol (b3) is branched, suitably a branched alkyl group. The hydrocarbyl group may be substituted with methyl groups along the main chain thereof. Suitably the hydrocarbyl group comprises a plurality of carbon atoms which each have two methyl substituents. Suitably the branching points of the hydrocarbyl group are substantially equally spaced along the main chain of the hydrocarbyl group of phenol component (b3).

In such embodiments, the hydrocarbyl substituent may be derived from a polyalkene, suitably a polymer of a branched alkene, for example polyisobutene or polypropene. Suitably the hydrocarbyl group is a poly(isobutene) derived substituent. The phenol (b3) may therefore comprise a hydrocarbyl substituent having the repeating unit:

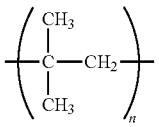

Polyisobutenes are prepared by the addition polymerisation of isobutene, $(CH_3)_2C{=}CH_2$. Each molecule of the resulting polymer will include a single alkene moiety. The suitable polyisobutenes are as described above.

Methods of preparing such substituted phenols, for example polyisobutene substituted phenols are known to the person skilled in the art, and include the methods described in EP831141, which is incorporated herein by reference.

In some embodiments, the hydrocarbyl substituent of component (b3) has an average molecular weight of 200 to 3000, preferably a molecular weight of at least 225, suitably at least 250, preferably at least 275, suitably at least 300, for example at least 325 or at least 350. In some embodiments the hydrocarbyl substituent of component (b3) has an average molecular weight of at least 375, preferably at least 400, suitably at least 475, for example at least 500.

In some embodiments component (b3) may include a hydrocarbyl substituent having an average molecular weight of up to 2800, preferably up to 2600, for example up to 2500 or up to 2400.

In some embodiments the hydrocarbyl substituent of component (b3) has an average molecular weight of from 400 to 2500, for example from 450 to 2400, preferably from 500 to 1500, suitably from 550 to 1300.

In some embodiments the hydrocarbyl substituent of component (b3) has an average molecular weight of from 200 to 600.

In some embodiments the hydrocarbyl substituent of component (b3) has an average molecular weight of from 500 to 1000.

In some embodiments the hydrocarbyl substituent of component (b3) has an average molecular weight of from 700 to 1300.

In some embodiments the hydrocarbyl substituent of component (b3) has an average molecular weight of from 1000 to 2000.

In some embodiments the hydrocarbyl substituent of component (b3) has an average molecular weight of from 1700 to 2600, for example 2000 to 2500.

Unless otherwise mentioned all average molecular weights referred to herein are number average molecular weights.

Suitable Mannich additives (b) and methods of preparing such additives will be known to the person skilled in the art and include the compounds described, for example, in the applicant's publications WO2009040582 and WO2013017887, which are incorporated herein by reference.

In some preferred embodiments, additive (b) the reaction product of (b1) formaldehyde, (b2) a polyethylene polyamine; and (b3) a para-substituted monoalkyl phenol.

In some preferred embodiments, additive (b) the reaction product of (b1) formaldehyde, (b2) a polyethylene polyamine; and (b3) a para-substituted monoalkyl phenol, wherein the alkyl group of the monoalkyl phenol has 4 to 28 carbon atoms.

An especially preferred additive (b) for use herein is the reaction product of (b1) formaldehyde, (b2) ethylene diamine and (b3) dodecyl phenol, suitably para-dodecyl phenol.

Components (b1), (b2) and (b3) used to prepare the Mannich product additives of the present invention may each comprise a mixture of compounds and/or a mixture of isomers.

To form the Mannich additive (b), components (b1) and (b2) are preferably reacted in a molar ratio of 7-1.1:1 (aldehyde:amine), preferably 2-6:1 more preferably 3-5:1.

Component (b2) and component (b3) are preferably reacted in a molar ratio (amine:phenol) of 1:1.1-4, preferably 1:1.2-3, more preferably 1:1.5-2.

Preferred Mannich additives (b) are formed by reacting components (b1), (b2) and (b3) in a molar ratio of 1.1-5 parts (b1) to 1 part (b2) to 1.1-2 parts (b3), suitably in a molar ratio of 3-5 parts (b1) to 1 part (b2) to 1.5-2 parts (b3).

In some embodiments, the Mannich additive (b) is formed by reacting (b1) formaldehyde, (b2) polyethylene polyamine; and (b3) a para-substituted monoalkyl phenol, in a molar ratio of 1.1-5 parts (b1) to 1 part (b2) to 1.1-2 parts (b3).

In some embodiments, the Mannich additive (b) is formed by reacting (b1) formaldehyde, (b2) ethylene diamine and (b3) dodecyl phenol, suitably para-dodecylphenol, in a molar ratio of 3-5 parts (b1) to 1 part (b2) to 1.5-2 parts (b3).

(c) The Reaction Product of a Carboxylic Acid-Derived Acylating Agent and an Amine In some embodiments the present invention involves the use as an additive of (c) the reaction product of a carboxylic acid-derived acylating agent and an amine.

These compounds may also be referred to herein in general as acylated nitrogen-containing compounds.

Suitable acylated nitrogen-containing compounds may be made by reacting a carboxylic acid acylating agent with an amine and are known to those skilled in the art.

Suitable carboxylic acid-derived acylating agents are hydrocarbyl substituted carboxylic acid-derived acylating agents. Preferred hydrocarbyl substituted carboxylic acid-derived acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention. These are suitably as previously described herein in relation to the preparation of some preferred quaternary ammonium salts (a).

Especially preferred PIBSAs are those having a PIB molecular weight (Mn) of from 300 to 2,800, preferably from 450 to 2,300, more preferably from 500 to 1,300 or from 500 to 1,000.

In preferred embodiments the reaction product of the carboxylic acid derived acylating agent and an amine includes at least one primary or secondary amine group.

A preferred acylated nitrogen-containing compound for use herein is prepared by reacting a poly(isobutene)-substituted succinic acid-derived acylating agent (e.g. anhydride, acid, ester, etc.) wherein the poly(isobutene) substituent has a number average molecular weight (Mn) of between 170 to 2800 with a mixture of ethylene polyamines having 2 to about 9 amino nitrogen atoms, preferably about 2 to about 8 nitrogen atoms, per ethylene polyamine and about 1 to about 8 ethylene groups. These acylated nitrogen compounds are suitably formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. Acylated amino compounds of this type and their preparation are well known to those skilled in the art and are described in for example EP0565285 and U.S. Pat. No. 5,925,151.

In some preferred embodiments additive (c) is formed by the reaction of a polyisobutene-substituted succinic acid-derived acylating agent and a polyethylene polyamine. Suitable compounds are, for example, described in WO2009/040583, which is incorporated herein by reference.

In some preferred embodiments, the reaction product of a carboxylic acid-derived acylating agent and an amine (c) comprises the reaction product of (c1) a polyisobutene-substituted succinic acid or succinic anhydride and (c2) a polyethylene polyamine selected from ethylenediamine, diethylenetriamine, triethylenetetramine, tetraethylenepentamine, pentaethylenehexamine, hexaethylene-heptamine and mixtures and isomers thereof; wherein the polyisobutene substituent has a number average molecular weight of between 500 and 2000, suitably between 500 and 1,000 or between 600 and 1200.

In a preferred embodiment, additive (c) is the reaction product of (c1) a polyisobutene-substituted succinic acid or succinic anhydride, wherein the polyisobutene substituent has a number average molecular weight of between 500 and 1,000, and (c2) tetraethylenepentamine.

In some embodiments of the use or method of the present invention, the diesel fuel composition comprises from 0.1 to 10000 ppm, preferably from 1 to 1000 ppm, preferably from 5 to 250 ppm, for example 5 to 100 ppm of additive (a) a quaternary ammonium salt additive.

The diesel fuel composition suitably comprises from 0.1 to 10000 ppm, preferably from 1 to 1000 ppm, preferably from 5 to 500 ppm, for example 5 to 250 ppm of additive (b) a product of a Mannich reaction between (b1) an aldehyde, (b2) an amine and (b3) an optionally substituted phenol.

Additives (a) and (b) may be provided as an additive composition comprising additives (a) and (b) and optionally a suitable solvent. Suitably additives (a) and (b) are present in such an additive composition in a sufficient amount, and the additive composition is used in the fuel composition in a sufficient amount to provide the concentrations of additives (a) and (b) in the fuel composition as defined above.

In some embodiments, the diesel fuel composition comprises from 1 to 1000 ppm, preferably from 5 to 100 ppm of additive (a) and from 1 to 1000 ppm, preferably 5 to 100 ppm of additive (b).

In some embodiments, the diesel fuel composition comprises from 1 to 1000 ppm, preferably from 5 to 100 ppm of additive (c).

Each of additives (a), (b) and (c) may be provided as a mixture of compounds. The above amounts refer to the total of all such compounds present in the composition.

For the avoidance of doubt the above amounts refer to the amount of active additive compound present in the composition and ignore any impurities, solvents or diluents which may be present.

In some embodiments additives (a) and (b) are present in a weight ratio of from 2:1 to 1:2, preferably around 1.2:1.

In some preferred embodiments, additive (a) comprises a quaternary ammonium salt formed by reacting methyl salicylate, dimethyl oxalate or propylene oxide (optionally in combination with an acid) with the reaction product of (a1) a polyisobutylene-substituted succinic anhydride having a PIB molecular weight (Mn) of 700 to 1300 and (a2) an amine of formula (II), preferably dimethylaminopropylamine; and additive (b) comprises the reaction product of (b1) formaldehyde, (b2) a polyethylene polyamine and (b3) a para-substituted monoalkyl phenol, preferably dodecyl phenol.

In the use and method of the present invention, the additives (a) and (b) may be added to a diesel fuel at any convenient place in the supply chain. For example, the additives may be added to fuel at the refinery, at a distribution terminal or after the fuel has left the distribution terminal. If the additives are added to the fuel after it has left the distribution terminal, this is termed an aftermarket application. Aftermarket applications include such circumstances as adding the additives to the fuel in the delivery tanker, directly to a customer's bulk storage tank, or directly to the end user's vehicle tank. Aftermarket applications may include supplying the additives in small bottles suitable for direct addition to fuel storage tanks or vehicle tanks.

By diesel fuel we include any fuel suitable for use in a diesel engine either for road use or non-road use. This includes but is not limited to fuels described as diesel, marine diesel, heavy fuel oil, industrial fuel oil, etc.

The diesel fuel composition used in the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition may comprise non-renewable Fischer-Tropsch fuels such as those described as GTL (gas-to-liquid) fuels, CTL (coal-to-liquid) fuels and OTL (oil sands-to-liquid).

The diesel fuel composition may comprise a renewable fuel such as a biofuel composition or biodiesel composition.

The diesel fuel composition may comprise first generation biodiesel. First generation biodiesel contains esters of, for example, vegetable oils, animal fats and used cooking fats or oils. This form of biodiesel may be obtained by transesterification of oils, for example rapeseed oil, soybean oil, canola oil, safflower oil, palm oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, usually in the presence of a catalyst.

The diesel fuel composition may comprise second generation biodiesel. Second generation biodiesel is derived from renewable resources such as vegetable oils and animal fats and processed, often in the refinery, using, for example, hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

In some embodiments the diesel fuel composition may comprise a pyrolysis oil, for example a plastic pyrolysis oil or a biomass (wood, vegetable oil, algae) pyrolysis oil.

The diesel fuel composition may contain blends of any or all of the above diesel fuel compositions.

In some embodiments the diesel fuel composition may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the diesel fuel composition is neat biodiesel.

In some embodiments the diesel fuel composition is neat renewable diesel.

The diesel fuel composition may be suitably 100% derived from renewable sources. Such a fuel is referred to herein as a renewable diesel. A suitable renewable diesel is a renewable diesel obtained by the hydrodeoxygenation of fats and oils (the fats and oils being derived from renewable sources). For example, the renewable diesel may be a hydrotreated triglyceride oil such as a hydrogenated vegetable oil (HVO). The HVO suitably complies with EN15940 Class A. Such HVO fuels are available from Coryton and Neste.

Such renewable diesel fuels are suitably produced from raw materials of biological origin. These may suitably be selected from vegetable oils, animal fats, fish oils and mixtures thereof. Examples include rapeseed oil, canola oil, tall oil, sunflower oil, soybean oil, hemp oil, olive oil, linseed oil, mustard oil, *carinata* oil, palm oil, palm kernel oil, peanut oil, castor oil, coconut oil, animal fats such as tallow or recycled food fats, raw materials resulting from genetic engineering, and biological raw materials produced from microorganisms such as algae and bacteria.

Preferably, the renewable diesel is provided by a process involving hydrodeoxygenation (HDO) and optionally isomerization steps. The hydrodeoxygenation (HDO) step results in the decomposition of the structures of the biological esters or of the triglyceride constituents, in the elimination of the oxygen-bearing, phosphorus-bearing and sulfur-bearing compounds and in the hydrogenation of olefinic bonds. The product resulting from the hydrodeoxygenation reaction may then be isomerized. A fractionation step may optionally follow the hydrodeoxygenation and isomerization steps.

Preferably the renewable diesel has a cetane number of between 50 and 90, preferably between 55 and 90, more preferably between 60 and 85. Cetane number is suitably measured by the standard test method set out in IP 498.

Preferably the renewable diesel has a cloud point of less than 25° C., more preferably less than 10° C. Suitably the paraffinic fuel has a cloud point of less than −5° C., for example less than −10° C. Cloud point may suitably be measured using the standard test method described in IP 219.

Preferably the renewable diesel has a kinematic viscosity at 40° C. of 1 to 20 $mm^2s^{-1}$, preferably from 2 to 15 $mm^2s^{-1}$, more preferably from 2 to 10 $mm^2s^{-1}$, most preferably from 2 to 4.5 $mm^2s^{-1}$. Kinematic viscosity may be measured according to ASTM D445.

Preferably the renewable diesel has an initial boiling point (IBP) and a final boiling point (FBP) within the range 265 to 380° C., more preferably within the range 275 to 380° C. and most preferably within the range 290 to 375° C.

Preferably the renewable diesel has a boiling range of less than 80° C., preferably less than 70° C., suitably less than 60° C., for example from 30 to 60° C. Boiling range is used to refer to the difference between the final boiling point and the initial boiling point.

The initial boiling point, final boiling point and boiling range can be determined according to the method set out in IP 123.

In preferred embodiments the renewable diesel comprises predominately straight chain alkanes and branched alkanes.

Preferably the renewable diesel comprises less than 20 wt % cycloalkanes, preferably less than 10 wt %, suitably less than 5 wt %, preferably less than 1 wt %, for example less than 0.1 wt %.

For the avoidance of doubt by the term cycloalkane or naphthene is used to refer to any saturated hydrocarbon compound which includes a non-aromatic cyclic moiety.

Preferably the weight of ratio n-paraffins to i-paraffins present in the renewable diesel is from 99:1 to 1:99, more preferably from 90:10 to 10:99, preferably from 75:25 to 25:75. Techniques for determining the ratio of n-paraffins to i-paraffins are known to the person skilled in the art and include gas chromatography.

Ratios of n-paraffins and i-paraffins present in a fuel typically depend on the hydrotreatment method used to prepare the fuel, which may also include an isomerisation step.

The renewable diesel may comprise greater than 4 wt %, preferably greater than 5 wt %, of C14 to C16 n-alkanes.

The renewable diesel may comprise less than 8 wt %, preferably less than 6 wt %, of C14 to C16 n-alkanes.

The renewable diesel may comprise from 4 to 8 wt %, preferably from 5 to 6 wt %, of C14 to C16 n-alkanes.

The renewable diesel may comprise greater than 5 wt %, preferably greater than 7 wt %, more preferably greater than 10 wt %, of C14 to C18 n-alkanes.

The renewable diesel may comprise less than 20 wt %, preferably less than 18 wt %, more preferably less than 16 wt %, of C14 to C18 n-alkanes.

The renewable diesel may comprise from 5 to 20 wt %, preferably from 7 to 18 wt %, more preferably from 10 to 16 wt %, of C14 to C18 n-alkanes.

The renewable diesel may comprise from 3 to 30 wt % of C6 to C24 n-alkanes (i.e. n-paraffin).

The renewable diesel suitably has an oxygen content of less than 1 wt %, preferably less than 0.1 wt % when measured according to EN 14078.

The renewable diesel suitably has an aromatic content of less than 5 wt %, preferably less than 1 wt %.

Preferably the renewable diesel is a hydrotreated triglyceride oil, suitably an HVO, having the contents and properties described above.

Suitably the renewable diesel complies with the standard specification set out in EN15940.

Preferably the renewable diesel is a hydrotreated triglyceride oil, suitably an HVO, having an aromatic content of less than 5 wt %, preferably less than 1 wt %.

Preferably the renewable diesel is a hydrotreated triglyceride oil, suitably an HVO, having cetane number of between 50 and 90, preferably between 55 and 90, more preferably between 60 and 85 (according to IP 498); a cloud point of less than 10° C., preferably less than −5° C. (according to IP 219); and a kinematic viscosity at 40° C. of from 1 to 20 $mm^2s^{-1}$, preferably from 2 to 10 $mm^2s^{-1}$ (according to ASTM 445).

Preferably the renewable diesel is a hydrotreated triglyceride oil, suitably an HVO, having an initial boiling point and a final boiling point within the range 265 to 380° C., preferably 290 to 375° C. and a boiling range of less than 80° C., preferably 30 to 60° C.

The diesel fuel composition used in the present invention suitably comprises at least 10 vol % renewable diesel as defined above, suitably at least 25 vol %, at least 50 vol % or at least 90 vol % renewable diesel, suitably wherein the renewable diesel is hydrotreated triglyceride oil, preferably HVO.

A fuel which comprises 100% renewable diesel is denoted as R100, a fuel which comprises 90% mineral diesel and 10% renewable diesel (by volume) is known as R10; fuel comprising 50% mineral diesel and 50% renewable diesel (by volume) is known as R50; and so on.

In some preferred embodiments, the fuel composition of the present invention comprises renewable diesel and one or more further components selected from biodiesel, mineral diesel and mixtures thereof.

In some embodiments the fuel composition comprises renewable diesel and at least 5 vol % biodiesel.

In some embodiments the fuel composition comprises renewable diesel and at least 20 vol % biodiesel.

In preferred embodiments the diesel fuel composition is neat (i.e. 100 vol %) renewable diesel as defined above, preferably neat hydrotreated triglyceride oil, preferably neat HVO. Such a fuel may be referred to as an R100 diesel fuel.

The inventors have found that the combination of additives (a) and (b) used in the present invention are particularly effective in reducing the impact of deposits in a post combustion system of a diesel engine when combusting a diesel fuel composition comprising a renewable diesel as defined above, in particular when combusting neat renewable diesel, such as neat HVO.

In some embodiments the fuel composition may comprise GTL fuel or be a neat GTL fuel.

In some embodiments the diesel fuel composition may comprise a secondary fuel, for example ethanol. Preferably however the diesel fuel composition does not contain ethanol.

The diesel fuel composition used in the present invention may contain a relatively high sulphur content, for example greater than 0.05% by weight, such as 0.1% or 0.2%.

However, in preferred embodiments the diesel fuel composition has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

The diesel fuel composition used in the present invention preferably comprises at least 5 wt % biodiesel and less than 50 ppm sulphur.

Various metal species may be present in the diesel fuel composition. This may be due to contamination of the fuel during manufacture, storage, transport or use or due to contamination of fuel additives. Metal species may also be added to fuels deliberately. For example, transition metals are sometimes added as fuel borne catalysts, for example to improve the performance of diesel particulate filters.

Other metal-containing species may also be present as a contaminant, for example through the corrosion of metal and metal oxide surfaces by acidic species present in the fuel or from lubricating oil. In use, fuels such as diesel fuels routinely come into contact with metal surfaces for example, in vehicle fueling systems, fuel tanks, fuel transportation means etc. Typically, metal-containing contamination may comprise transition metals such as zinc, iron and copper; Group I or Group II metals and other metals such as lead.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the diesel fuel may comprise metal-containing species comprising a fuel-borne catalyst. Preferably, the fuel borne catalyst comprises one or more metals selected from iron, cerium, platinum, manganese, Group I and Group II metals e.g., calcium and strontium. Most preferably the fuel borne catalyst comprises a metal selected from iron and cerium.

Typically, the total amount of all metal-containing species in the diesel fuel, expressed in terms of the total weight of metal in the species, is between 0.1 and 50 ppm by weight, for example between 0.1 and 20 ppm, preferably between 0.1 and 10 ppm by weight, based on the weight of the diesel fuel.

The diesel fuel compositions used in the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

Suitable cetane number improvers may be selected from C2-24 alkyl nitrates and dialkyl peroxides, preferably decyl nitrate, 2-ethylhexyl nitrate and di-tert-butyl peroxides. Such cetane number improvers are suitably used at a concentration of 50-6,000 ppm, preferably at 50-750 ppm based on the diesel fuel composition.

The present invention reduces the impact of deposits in the EGR system and/or the post combustion system of a diesel engine.

The diesel engine may be a direct injection diesel engine or an indirect injection diesel engine.

In some embodiments the engine may be an off road engine, for example a marine, rail or stationary engine. Stationary engines include engines for power generation and pumping.

Most preferably the engine is a direct injection diesel engine.

The post combustion deposit control additives used in the present invention have been found to be particularly effective in modern diesel engines having a high pressure fuel system.

Suitably the present invention may be used to reduce the formation or deposits in the post combustion system of a diesel engine having a high pressure fuel system. Suitably the diesel engine has a fuel pressure in excess of 1350 bar ($1.35\times10^8$ Pa). It may have a pressure of up to 2000 bar ($2\times10^8$ Pa) or more.

Such diesel engines may be characterised in a number of ways.

Such engines are typically equipped with fuel injection equipment meeting or exceeding "Euro 5" emissions legislation or equivalent legislation in the US or other countries.

Such modern diesel engines may be characterised by a fuel injection system which provides a fuel pressure of more than 1350 bar, preferably more than 1500 bar, more preferably more than 2000 bar.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurising the fuel, the fuel gets hot, often to temperatures around 100° C., or above.

Preferably, the diesel engine has fuel injection system which comprises a common rail injection system.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

The EGR system recirculates the exhaust gases to lower the oxygen concentration in the combustion chamber. This reduces the generation of $NO_x$ gases.

The EGR system includes a cooler. This component lowers the temperature of the recirculated exhaust gases.

Exhaust gases enter the EGR system after they pass through or are generated within the combustion chamber. The exhaust gases may contain materials resulting from incomplete combustion. These materials may deposit within the EGR system. One component where deposit build up frequently occurs is in the cooler of the EGR system.

Previously these deposits have not been studied in the same level of detail as other fuel system or combustion deposits. Indeed the finding of such deposits appears to be a relatively recent phenomenon. Particularly strong reviews of the work done to elucidate how they may form and why they are a problem can be found in Lance et al International Journal of Heat and Mass Transfer 126, (2018), 509-520 and SAE 2014-01-0629.

The present inventors have studied the nature of the deposits found in the EGR system and in particular within the cooler. It has been surprisingly found that the formation of these deposits in particular can be reduced by the addition of additives (a) and (b) into the diesel fuel combusted in the engine.

The use of the first aspect and/or the method of the second aspect may involve reducing the impact of deposits in the exhaust gas recirculation system of a diesel engine which is a high pressure, low pressure, hybrid or dedicated EGR system. Suitably the exhaust gas recirculation system is a high pressure, hybrid or dedicated EGR system. Preferably the exhaust gas recirculation system is a high pressure or hybrid EGR system. Most preferably, the exhaust gas recirculation system is a high pressure EGR system.

Preferably the use or method of the present invention reduces the formation of deposits in a high pressure EGR system of a diesel engine.

By reducing the formation of deposits in an EGR system we mean that when a fuel comprising the EGR deposit reducing additive is combusted in an engine, a reduced level of deposits is obtained compared to when an otherwise identical fuel is combusted under identical conditions except for the inclusion of the EGR deposit reducing additive.

Suitably the use of additives (a) and (b) reduces the formation of deposits in an EGR system by at least 5%, preferably by at least 10%, for example at least 15% or at least 20%.

In some embodiments the use of additives (a) and (b) may reduce the formation of deposits in an EGR system by at least 30%, for example at least 40% or at least 50%.

Suitably the use of additives (a) and (b) reduces the formation of deposits in the cooler an EGR system by at least 5%, preferably by at least 10%, for example at least 15% or at least 20%.

In some embodiments the use of additives (a) and (b) may reduce the formation of deposits in the cooler of an EGR system by at least 30%, for example at least 40% or at least 50%.

The reduction in deposits in an EGR system may be measured by any suitable means.

One simple means by which the level of deposits in an EGR system may be determined is by weighing the system before and after use. One or more parts of the system may be weighed.

Preferably the present invention reduces the total amount of deposits formed in an EGR system by at least 5%, preferably at least 10%, more preferably at least 15%, for example at least 20% or at least 30%.

Suitably the present invention reduces the total amount of deposits formed within the cooler of an EGR system.

Preferably the present invention reduces the total amount of deposits formed within the cooler of an EGR system by at least 5%, preferably at least 10%, more preferably at least 15%, for example at least 20% or at least 30%.

The deposits that form in the EGR system may be analysed. This may be achieved, for example by extracting the deposits or a portion thereof into a solvent. The sample may be separated into soluble and non soluble fractions; these may then be separately analysed by methods known to those skilled in the art, for example elemental analysis, thermogravimetric analysis and/or gas chromatography mass spectrometry.

The deposits that form in the EGR system may be analysed for example by thermogravimetric analysis (TGA). A significant proportion of the deposits that occur on the cooler of an EGR system were found to be carbonaceous deposits that degrade at temperatures of between 400 to 540° C. when subjected to thermogravimetric analysis (TGA).

Thermogravimetric analysis (or TGA) involves measuring the mass of a sample over time as it is heated. This technique is well known to the person skilled in the art and the selection of an appropriate method and suitable equipment will be within the competence of one skilled in the art.

The post combustion system of diesel engines is provided to reduce the emission of pollutants such as particulates and harmful gases into the environment. The formation of deposits on parts of the post combustion system can reduce the efficiency of the system and lead to an increase in the emission of particulate deposits and/or harmful gases.

In some embodiments the impact of the deposits may be reduced by a change in the nature of deposits.

Preferably the present invention reduces the formation of deposits in the post combustion system.

By reducing the formation of deposits in a post combustion system we mean that when a fuel comprising the additives (a) and (b) is combusted in an engine, a reduced level of deposits is obtained compared to when an otherwise identical fuel is combusted under identical conditions except for the inclusion of the post combustion deposit reducing additive.

Suitably the use of additives (a) and (b) reduces the formation of deposits in one or more components of the post combustion system by at least 0.01%, preferably by at least 0.1%, for example at least 1% or at least 2%.

In some embodiments the use of additives (a) and (b) may reduce the formation of deposits in one or more components of the post combustion system by at least 3%, for example at least 4% or at least 5%.

By the post combustion system of a diesel engine we mean to refer to any part of the engine through which exhaust gases pass after finally leaving the combustion system.

The post combustion system may comprise one or more components selected from a turbocharger, a diesel oxidation catalyst, a diesel particulate filter, a selective catalytic reduction unit and an ammonia oxidation unit. The post combustion system may include these components in any order and this may order vary from vehicle to vehicle. The present invention may reduce the impact of deposits in or on one or more of these components.

In some embodiments the use of additives (a) and (b) reduces the formation of deposits in the turbocharger, suitably by at least 0.01%, preferably by at least 0.1%, for example at least 1% or at least 2%.

The present invention may reduce deposits on a fixed geometry turbocharger or on a variable geometry turbocharger. Variable geometry turbochargers having moving parts which are controlled by the engine management system. This allows the aspect ratio of the turbocharger to be changed to optimise performance at different speeds. The formation of deposits can lead to parts sticking. As a result the turbocharger will not provide the correct level of boost and may ultimately fail. The reduction of deposits on the turbocharger is therefore highly beneficial.

Preferably the present invention reduces deposits on the turbine wheel of the turbocharger.

In some embodiments the use of additives (a) and (b) may reduce the formation of deposits in the turbocharger by at least 3%, for example at least 4% or at least 5%.

In some embodiments the use of additives (a) and (b) reduces the formation of deposits in the diesel oxidation catalyst, suitably by at least 0.01%, preferably by at least 0.1%, for example at least 1% or at least 2%.

The diesel oxidation catalyst typically comprises a ceramic support structure coated with metals such as palladium, platinum and/or rhodium. The formation of deposits in the diesel oxidation catalyst can lead to a reduction in flow rate through the catalyst and/or poisoning of the catalyst.

In some embodiments the use of additives (a) and (b) may reduce the formation of deposits in the diesel oxidation catalyst by at least 3%, for example at least 4% or at least 5%.

Suitably the use of additives (a) and (b) reduces the formation of deposits in the diesel particulate filter, suitably by at least 0.01%, preferably by at least 0.1%, for example at least 1% or at least 2%.

Suitably the use of additives (a) and (b) reduces the accumulation of soot in the diesel particulate filter, suitably by at least 0.01%, preferably by at least 0.1%, for example at least 1% or at least 2%.

The diesel particulate filter is designed to capture from the exhaust gases particulates such as soot which are formed in the combustion chamber. These particulates collect on the filter and are burnt off at intervals by the increasing temperature of the exhaust gases and the injection of additional fuel. This process is known as filter regeneration.

The present invention may increase the interval between regenerations. This can improve the fuel economy of the engine and reduce emissions. By a reduction in regenerations we mean to include a reduction in active, passive or parked regenerations of the diesel particulate filter. For example there may be a reduction in the number of regeneration events per 1000 km.

In some embodiments the use of additives (a) and (b) may reduce the formation of deposits in the diesel particulate filter by at least 3%, for example at least 4% or at least 5%.

In some embodiments the use of additives (a) and (b) reduces the formation of deposits in the selective catalytic reduction unit, suitably by at least 0.01%, preferably by at least 0.1%, for example at least 1% or at least 2%.

Selective catalytic reduction is used to remove NOx and other harmful gases from the exhaust stream and involves the use of ammonia as a reductant in the presence of a catalyst. The selective catalytic reduction unit comprises a porous ceramic support and a catalyst, typically comprising a metal or a zeolite.

The formation of deposits on the selective catalytic reduction unit can lead to a reduction in flow rate through the unit and/or poisoning of the catalyst.

In some embodiments the use of additives (a) and (b) may reduce the formation of deposits in the selective catalytic reduction unit by at least 3%, for example at least 4% or at least 5%.

In some embodiments the use of additives (a) and (b) reduces the formation of deposits in the ammonia oxidation catalyst, suitably by at least 0.01%, preferably by at least 0.1%, for example at least 1% or at least 2%.

The ammonia oxidation catalyst is used to oxidise any ammonia present in the exhaust gases after passing through the selective catalytic reduction unit.

The formation of deposits on the ammonia oxidation catalyst can lead to a reduction in flow rate through the catalyst and/or poisoning of the catalyst.

In some embodiments the use of additives (a) and (b) may reduce the formation of deposits in the ammonia oxidation catalyst by at least 3%, for example at least 4% or at least 5%.

In some embodiments the use of additives (a) and (b) reduces the formation of deposits on sensors within the post combustion system, suitably by at least 0.01%, preferably by at least 0.1%, for example at least 1% or at least 2%.

Sensors may be present in the post combustion to measure temperature, pressure and/or concentrations of gases such as $NO_x$ in the exhaust gases. If deposits are present on or around the sensors they may be unable to function correctly or inaccurate measurements may be taken leading to incorrect information being provided to the engine management system. This can lead to poor performance of the engine.

In some embodiments the use of additives (a) and (b) may reduce the formation of deposits on sensors within the post combustion system by at least 3%, for example at least 4% or at least 5%.

The reduction in deposits in post combustion system may be measured by any suitable means.

One simple means by which the level of deposits in a part of a post combustion system may be determined is by weighing the part of the system before and after use. One or more parts of the system may be weighed.

Other less direct methods may also be used. For example an improvement in fuel economy may indicate longer regeneration intervals on a diesel particulate filter.

Preferably the present invention provides an improvement in fuel economy of at least 0.1%, preferably at least 0.5%, suitably at least 1%, for example at least 2%.

Preferably the present invention provides a reduction in fuel consumption of at least 0.1% over a set distance, preferably a reduction of at least 0.5%, suitably at least 1%, for example at least 2%.

Preferably the present invention provides an increase in vehicle range of at least 1%, preferably at least 0.5%, suitably at least 1%, for example at least 2%.

Fuel consumption may be calculated from the fuel mass flow rate and equivalent road speed and then converted into vehicle range by factoring in the fuel tank size.

The vehicle connected area network (CAN) system may be interrogated to assess the performance of components such as the turbocharger, the diesel particulate filter, the diesel oxidation catalyst and the selective catalytic reduction unit.

The invention may result in fewer error messages being provided by the engine management system to a driver.

An increase in the necessary maintenance intervals for a catalytic components may also indicate improved performance due to deposit reduction.

The deposits that form in the post combustion system may be analysed. This may be achieved, for example by extracting the deposits or a portion thereof into a solvent. The sample may be separated into soluble and non soluble fractions; these may then be separately analysed by methods known to those skilled in the art, for example elemental analysis, thermogravimetric analysis and/or gas chromatography mass spectrometry.

Thermogravimetric analysis (or TGA) involves measuring the mass of a sample over time as it is heated. This technique is well known to the person skilled in the art and the selection of an appropriate method and suitable equipment will be within the competence of one skilled in the art.

When post composition deposits contain soot, the soot density can be measured, for example using an AVL483 microsoot sensor.

Particle size of the soot can be measured by techniques known to these skilled in the art.

The reduction of deposits in the post combustion system of a diesel engine according to the present invention offers significant benefits.

These include, but are not limited to: an increase in power generation; an increase in torque; an increase in fuel economy; a reduction in emissions; a reduction in combustion chamber deposits; an acceleration improvement; driveability improvements; a reduction in cold start issues; lower soot formation; mitigation of lubricant degradation and/or performance loss; a reduction in diesel exhaust fluid and consumption e.g. urea consumption; reduction in wear on all post combustion components (including but not limited to the turbo charger, oxidation catalyst, DPF, SCR CAT, sensors, and injectors within the post combustion system); increased longevity of exhaust components; an increase in the maintenance period for the engine and/or post combustion components; the protection of intake components downstream of the EGR, for example swirl flaps, throttles and the intake manifold (due to a reduction in the likelihood of blocking etc.); a reduction in fuel consumption; and an increase in vehicle range.

In some embodiments of the present invention the use of additives (a) and (b) reduces the formation of deposits in an EGR system, preferably by at least 5%, for example by at least 20% or at least 50%.

In some embodiments the use of additives (a) and (b) reduces the impact of deposits on one or more of a turbocharger, a diesel oxidation catalyst, a diesel particulate filter, a selective catalytic reduction unit and an ammonia oxidation catalyst.

In some embodiments the use of additives (a) and (b) prevents and/or removes deposits on sensors within the post combustion system, for example deposits on $NO_x$ sensors, temperature sensors and/or pressure sensors.

In some embodiments the use of additives (a) and (b) reduces the formation of deposits in an EGR system, preferably by at least 5%, for example by at least 20% or at least 50%.

In some embodiments the use of additives (a) and (b) reduces the formation of deposits on a diesel particulate filter, suitably by at least 0.01%, preferably by at least 2%.

In some embodiments the use of additives (a) and (b) increases the interval between regenerations of a diesel particulate filter, suitably by at least 30 minutes, at least 60 minutes or at least 75 minutes.

The reductions and/or increases in the performance of the diesel fuel composition discussed above, as provided by the use of additives (a) and (b) of the present invention, are suitably as compared to a comparable diesel fuel composition which does not comprise additives (a) and (b), when used in the same or an equivalent engine or vehicle running for the same amount of time and/or covering the same distance, as appropriate.

Any feature of the invention may be combined with any other feature as appropriate.

In one preferred embodiment, there is provided a use of (a) and (b) as additives in a diesel fuel composition to reduce the formation of deposits on a diesel particulate filter of a post combustion system of a diesel engine when combusting said diesel fuel composition; wherein the diesel fuel composition is a biodiesel 100% derived from renewable sources; wherein:

(a) is one or more quaternary ammonium salt formed by reacting methyl salicylate, dimethyl oxalate or propylene oxide (optionally in combination with an acid) with the reaction product of (a1) a polyisobutylene-substituted succinic anhydride having a PIB molecular weight (Mn) of 700 to 1300 and (a2) an amine of formula (II), preferably dimethylaminopropylamine; and (b) comprises the reaction product of (b1) formaldehyde, (b2) a polyethylene polyamine and (b3) a para-substituted monoalkyl phenol, preferably dodecyl phenol.

Example 1

Additive A, a Mannich reaction product, was prepared as follows:

To a 1 L jacketed glass reactor, was transferred 4-dodecylphenol (129.6 g, 0.494 moles, 1.7 equivalents). Aromatic A150 solvent (95.2 g) was added and heated to 75° C. Ethylenediamine (17.5 g, 0.291 moles, 1 eq) was added and the mixture was heated to 90° C. 37% aq formalin (94.3 g, 1.16 moles, 4 equivs) was then added, keeping the reaction mixture temperature in the range 90-96° C. The reactor was sealed, and the temperature increased to 120° C. over 3 hrs. This was accompanied by a pressure increase to 0.8 barg. The reaction mixture was held for 3 hrs at 120-122° C., at pressure up to 1.1 barg. The reaction temperature was then decreased to ~95° C. and the pressure dropped to <0.5 bar, at which point the reactor was opened to the atmosphere. Agitation was stopped and the contents allowed to separate. The amber organic phase was washed twice with water at 90-90° C. Finally, any residual water was removed from the organic phase under reduced pressure, leaving a clear and bright amber liquid, additive A (235 g).

Example 2

Additive B, a quaternary ammonium salt additive, was prepared as follows:

HR 1000 MW polyisobuylene (126.37 g, 126 mmol, 1.0 eqs) was heated to 190° C. then maleic anhydride (12.47 g, 127 mmol, 1.0 eqs) added over 1 hour. The reaction was heated to 205° C. then held for eight hours. Unreacted maleic anhydride was removed by vacuum distillation. The resulting PIBSA was cooled to 120° C. and DMAPA (11.9 g, 116 mmol, 0.9 eq) charged keeping the reaction temperature in the range 120° C.-130° C. The reaction was stirred then the temperature increased to 140° C. to allow distillation of water. Once distillation was complete, methyl salicylate (17.36 g, 114 mmol, 0.9 eqs) was charged and the reaction heated at 140° C. until the reaction was complete. The reaction is diluted with solvent then cooled and discharged to provide the product, additive B (271.2 g).

Example 3

Additive C, a polyisobutenyl substituted succinimide additive, was prepared as follows:

Using the reaction set up of a 1 L jacketed glass reactor, fitted with a Dean Stark condenser, overhead stirrer, dropping funnel and nitrogen input. To the reactor was transferred 600 g of PIBSA (HR 750 MW PIB, 0.768 moles) and 483.33 g of Aromatic A150 solvent. The mixture was stirred and heated to 65° C. to form a homogenous liquid. Then tetraethylenepentamine (138.12 g, 0.729 mol) was charged to the reactor over 1 hour via the dropping funnel. The temperature of the mixture was increased to 135° C. and held for 1 hour allowing distillation of water. The temperature of the mixture was then increased to 165° C. and held for 3 hours. After distillation was complete the product, additive C, was cooled and transferred to storage (1208.32 g).

Example 4

Additives A, B and C were dosed in the amounts specified in Table 1 into a diesel fuel composition comprising 7 vol % RME in a mineral diesel fuel. The specification of the mineral diesel fuel is set out in Table 2.

TABLE 1

| Additive | ppm active |
|---|---|
| A | 36.4 |
| B | 33.6 |
| C | 120 |

TABLE 2

| Property | Units | Limits Min | Limits Max | Method |
|---|---|---|---|---|
| Cetane Number | | 52.0 | 54.0 | EN ISO 5165 |
| Density at 15° C. | kg/m$^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | mm$^2$/sec | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1,4) | µm | — | 400 | CEC F-06-A-96 |
| Fatty Acid Methyl Ester | | prohibited | | |

Example 5

The ability of the diesel fuel composition of example 4 to reduce the formation of deposits in the diesel particulate filter was assessed according to the following procedure:

A Mercedes Sprinter 314CDI equipped with a 2.1 litre direct-injection OM651 DE 22 LA engine was taken from the marketplace and installed on a state-of-the-art four-wheel chassis hub dynamometer. For the purposes of testing, the vehicle's fuel tank was bypassed by a test cell fuel supply. This ensured minimal carry over between the test fuels and accurate consumption measurement.

Following initial setup, two baseline runs were completed using additive-free EN590 compliant diesel with a 7% v/v RME content. The rate of DPF saturation was monitored via the vehicles CAN network from an immediately post-regeneration state to reported 100% load. The data was aligned to ~10% loading for comparison. The time to reach 100% load was consistent, averaging 2.76 hours.

The baseline fuel was dosed with additives in the amounts specified in table 1 and the DPF loading cycle repeated a further four times.

Once the Sprinter had switched to the additised fuel, an immediate 13% increase in time to regeneration versus the baseline average was observed.

Subsequent test runs conducted using the additised fuel consistently demonstrated improved performance compared with the previous. The fourth and final treated test run extended the time to regeneration to 4.90 hours, equivalent to a 77% increase.

These results are shown in FIG. 1.

Example 6

Additive D, a quaternary ammonium salt additive, was prepared as follows:

700 g (0.7 mol) of polyisobutylene (Mn 1000) was charged to a nitrogen flushed, jacketed reactor fitted with an overhead stirrer. The starting material was heated to 120° C. with stirring and nitrogen inerting was repeated. The reaction temperature was increased to 190° C. and maleic anhydride (82.4 g, 0.84 mol, 1.2 eq) was charged over 1 hour. After maintaining a temperature of 190° C. for a further 1 hour, the temperature was increased to 200-208° C. and held in this range for 8 hours. Vacuum (<30 mbar) was then applied for 2.5 hrs, whilst maintaining the reaction temperature, which reduced the level of residual maleic anhydride to ≤0.05 wt %. The reaction mass was cooled to ≤ 80° C. then discharged from the reactor.

PIBSA prepared as described above was charged to a nitrogen flushed, jacketed reactor fitted with an overhead stirrer and heated to 120° C. 3-(dimethylamino) propylamine (DMAPA) (1 eq relative to anhydride groups) was charged slowly, maintaining the reaction temperature between 120-130° C. After stirring at 120° C. for a further 1 hr, the reaction temperature was increased to 140° C. and held for 3 hrs with concurrent distillation of water. Methyl salicylate (2.1 eq relative to anhydride groups) was added in a single portion and heating was continued at 140° C. for 10 hours. The reaction mass was diluted with Aromatic 150 solvent to provide an overall solids content of 60 wt % prior to discharging from the reactor to provide additive D.

Example 7

Additive E, an oleyl amido propyl betaine additive, was prepared as follows:

A Lenz jacketed reactor was charged with 183.5 g (0.5 moles) oleyl amidopropyl dimethylamine (N-[3-(Dimethylamino)propyl]oleamide), 68 ml isopropylalcohol, 25.5 g (1.42 moles) water and 56.5 g (0.48 moles) sodium chloroacetate. The reaction mixture was heated to 80° C. and then heated for approx. 6 hrs at 80-85° C., before being cooled and allowed to stand under $N_2$ overnight. Following this the reaction mixture was re-heated to 60° C. and charged with 300 ml of isopropylalcohol (IPA) and 67.5 g of 2-ethylhexanol. Then the heat was increased further to 90° C. This afforded the azeotropic removal of $H_2O$ and IPA and precipitation of NaCl. A 100 mbar vacuum was applied to remove the remaining water and some solvent and the resulting suspension was filtered at 75-80° C. through a glass microfibre filter. 275.6 g of additive E was collected, which contained 53 wt % actives.

Example 8

Additive F, a quaternary ammonium salt of a polyisobutenyl substituted succinic half-acid half-amide, was prepared as follows:

A Lenz jacketed reactor equipped with a $N_2$ inlet, and reflux condenser was charged with 123.2 g (0.105 moles, 1.0 eq) of a polyisobutenyl substituted succinic anhydride (1000 MW PIB) and 123.0 g A150 solvent. 8.9 g (0.087 moles, 0.83 equivs) N,N-dimethylaminopropylamine (DMAPA) was added via a dropping funnel over approx. 30 mins. During the addition the reaction is kept at 20° C.-25° C. and following the addition the mixture was allowed to stir for 1 hr. The reaction mixture temperature had subsided to 17° C. and propylene oxide (12.2 g) was added over approx. 25 mins. Following the addition, the temperature was maintained at 20-22° C. whilst stirring. This was maintained for 4 hrs. The reactor was opened and left stirring for 2 hrs to let excess propylene oxide gas off. 264.4 g of a deep orange liquid of additive F was collected. The active content was 50 wt %.

Example 9

Additive G, a polyisobutenyl substituted succinic acid quaternary ammonium salt of hexadecyldimethyl amine, was prepared as follows:

A 1 L pressure reactor was charged with 251.1 g (0.20 moles) of Polyisobutenyl substituted succinic acid (1000 MW PIB) which was pre-warmed as it is a viscous liquid. Then 207 g of 2-ethylhexanol was added. 48.7 g (0.181 moles) of N,N-dimethylhexadecylamine was then added with stirring at 30° C. 21.0 g (0.362 moles, 2 eq) of propylene oxide was added and the reactor was sealed. Using nitrogen, the pressure in the reactor was increased to 2.0 bar, and the temperature was increased to 43-48° C. This was maintained overnight for a total of 17 hrs at which point the pressure in the reactor had decreased to 1.2 bar at a temperature of 43° C. When the pressure in the reactor decreased further to 1.0 bar, the reactor was unsealed and pressure released. Excess PO was allowed to gas off. This provided 610.5 g of clear orange liquid of additive G. A conversion of 93.4% was determined analytically. The active content was 60 wt %.

Example 10

Additives A and B were dosed in the amounts specified in Table 3 into the diesel fuel composition described below in relation to Example 11, which is a renewable diesel 100% derived from renewable sources (an HVO), to provide the fuel of Example 10, referred to as additised base fuel 1.

TABLE 3

| Additive | ppm active |
|---|---|
| A | 32 |
| B | 38 |

Example 11—Engine Testing

The ability of the combination of additives A and B to reduce the formation of deposits on a diesel particulate filter was assessed according to the following procedure.

The test vehicle was light goods vehicle (LGV) having a Euro 6d compliant, 2.1 litre HSDI engine. The vehicle mileage prior to the test was approximately 81,000 miles.

The following modifications were made to the vehicle:

The vehicle fuel supply was modified to facilitate switchover between different test fuels and to enable thermal conditioning of the fuel and measurement of fuel consumption.

The vehicle air intake system was modified to provide controlled combustion air at a known pressure and temperature.

Engine Operating Conditions

After engine start, the engine is driven to the following operating conditions where it is held for the duration of the test:

43% load @ 1500 RPM

Translated vehicle speed of 48.5 km/h

Dynamometer & Test Cell Equipment

The testing was carried out using a commercially available Hub Dynamometer and test cell. The vehicle controls were operated by a robot driver.

Method of Soot Deposition Measurement (DPF Loading)

Total soot mass was measured using an AVL 483 Micro-Soot Sensor (MSS) connected pre-aftertreatment (i.e. in the exhaust system prior to any filtration devices or catalyst). Soot particle number was measured for particles diameter 23 nm-2.5 um using an AVL 489 Advanced Particle Counter (APC), again connected pre-aftertreatment.

Prior to each measured DPF loading cycle, a "conditioning" DPF loading cycle (approx. 4-hours duration) was carried out under identical operating conditions. The loading cycle was allowed to run until a 100% DPF load was reported by the ECU, at which point an automatic regeneration was allowed to happen. Immediately following the completion of the automatic regeneration the measured DPF loading cycle commenced. The time taken from the initiation of the "measurement" cycle to reaching 100% DPF load was recorded.

The purpose of the "conditioning" DPF loading cycle was to achieve a repeatable starting condition prior to each measured DPF loading cycle. The fuel to be tested was used to perform the "conditioning" cycle in each instance. The basic premise of the procedure is shown below:

Engine Start

Soot Load [1]—"Conditioning"

Automatic Regeneration

Soot Load [2]—"Measurement"

Automatic Regeneration

Engine Stop

Change to next test fuel

The base fuel contained 100 vol % HVO compliant with EN15940 Class A from Coryton

| Test | Method | Unit | Limit Min Max | Result |
|---|---|---|---|---|
| Appearance ^ | Visual | | Report | C&B |
| Indicated Cetane Number ^ | ASTM D8183 | | min 70.0 | 76 |
| Density @ 15° C. [a] | EN ISO 12185 | kg/m$^3$ | 765.0 to 800.0 | 782.3 |
| Cloud Point ^ | EN ISO 23015 | ° C. | Report | −16 |
| CFPP ^ | EN 116 | ° C. | Report | −16 |
| Flash Point (Procedure A) [a] | EN ISO 2719 | ° C. | min 55.0 | 64.5 |
| Lubricity, wear scar diameter @ 60° C. ^ | EN ISO 12156-1 | μm | 460 max | 433 |
| Sulfur [a] | EN ISO 20846 | mg/kg | 5.0 max | <1.0 |
| Viscosity at 40° C.~ | EN ISO 3104 | mm$^2$/s | 2.000 to 4.500 | 3.04 |
| Water Content * | EN ISO 12937 | mg/kg | 200 max | 26 |
| FAME Content * | EN 14078 | % v/v | 7.0 max | <0.1 |
| Polycyclic Aromatics Content * | EN 12916 mod | % m/m | Report | <0.1 |
| Total Aromatics * | EN 12916 mod | % m/m | 1.1 max | <0.5 |
| Oxidation Stability* | EN 15751 | h | min 20.0 | >20.0 |
| Oxidation Stability (16 h) * | EN ISO 12205 | g/m$^3$ | 25 max | 16 |
| Ash Content * | EN ISO 6245 | % m/m | 0.010 max | <0.001 |
| Carbon Residue * | EN ISO 10370 | % m/m | 0.30 max | <0.10 |
| Copper Corrosion (3 h at 50° C.) * | EN ISO 2160 | Rating | Class 1 | 1A |
| Total Contamination * | EN 12662 | mg/kg | 24 max | 9 |
| Manganese * | EN 16576 | mg/L | 2.00 max | <0.10 |
| Carbon ^ | ASTM D3343 mod | % m/m | Report | 84.81 |
| Hydrogen ^ | ASTM D3343 | % m/m | Report | 15.19 |
| Oxygen ^ | EN 14078 | % m/m | Report | 0 |
| H/C Mole Ratio ^ | Calculation | | Report | 2.13 |
| Gross Calorific Value ^ | ASTM D3338 mod | MJ/kg | Report | 47.28 |
| Net Calorific Value ^ | ASTM D3338 mod | MJ/kg | Report | 44.06 |
| DISTILLATION (RECOVERED) | | | | |
| R250 [a] | EN ISO 3405 | % v/v | 65.0 max | 7.3 |
| R350 [a] | EN ISO 3405 | % v/v | min 85.0 | 98.2 |
| IBP [a] | EN ISO 3405 | ° C. | Report | 170.5 |

The additives used and the test results achieved are detailed in Table 4. The results are also represented in FIG. 1. These results show that in the test runs using the unadditised base fuel, the engine required regeneration after around 4 hours. In the first test run using the fuel of Example 10, the time before regeneration was required increased to around 5.5 hours. In the second test run using the additised fuel of Example 10, the time before regeneration increased further to around 7 hours.

TABLE 4

| Fuel | Additive | Treat rate (ppm active) | Time until DPF regeneration (hours:minutes) |
|---|---|---|---|
| Base fuel | None | — | 4:02 (average of 3 runs) |
| Additised Base fuel 1 | A, B | 32, 38 | 5:30 |
| Additised Base fuel 1 | A, B | 32, 38 | 6:43 |

Figure 2:
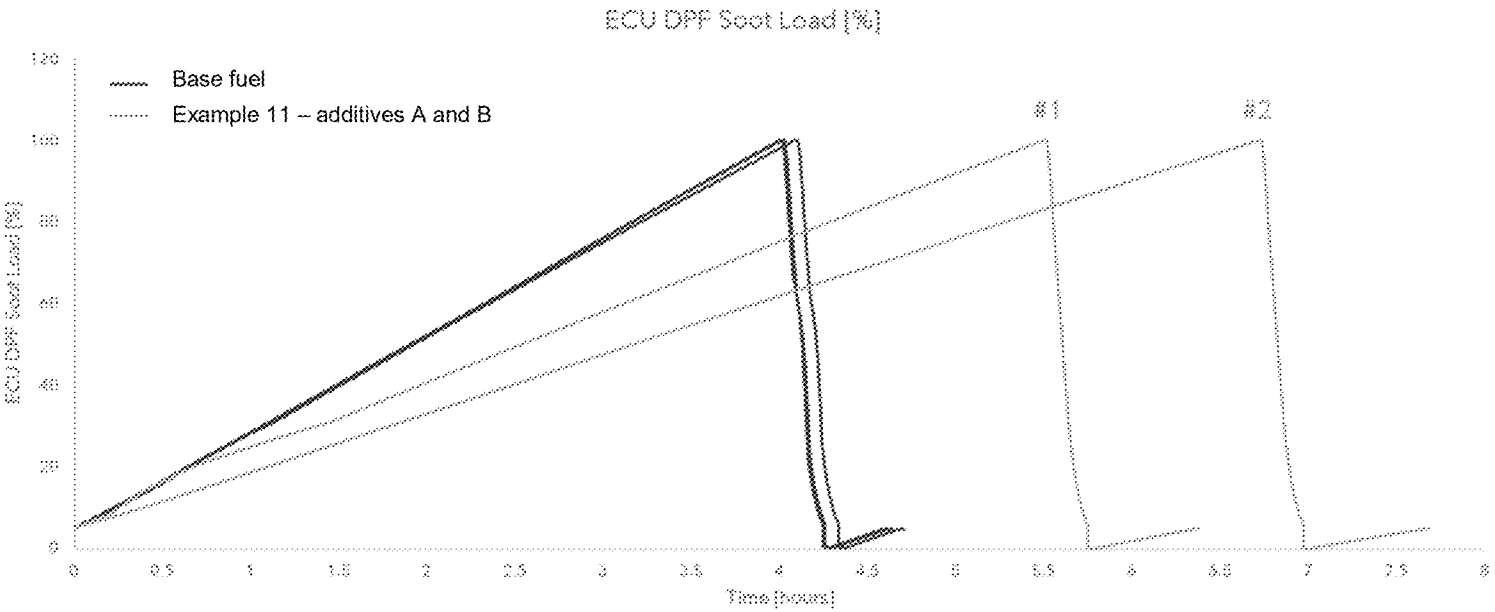
FIG. 2 shows ECU DPF Soot Load percent of the base fuel as well as with additives A and B.

Further results show the ECU DPF Soot Load percent of the base fuel as well as with additives A and B of Example 11 as represented in FIG. 2. These results show that the combination of additives of the present invention was effective in increasing the time until DPF regeneration and therefore effective in reducing the formation of deposits on a diesel particulate filter, when combusting biodiesel 100% derived from renewable sources (i.e. R100 renewable diesel).

These results demonstrate that the use of the additives, specifically the combination of additives (a) and (b) as defined herein, as additives in a diesel fuel composition may provide a significant reduction in deposits in the post combustion system of a diesel engine combusting said fuel, specifically a reduction in the soot deposited on the diesel particulate filter of the post combustion system, in particular wherein the diesel fuel composition is a biodiesel 100% derived from renewable sources.

The fuel consumption was monitored over the course of the test and the results are shown below in Table 5.

TABLE 5

| | Base Fuel | Additised Base fuel 1 | Change |
|---|---|---|---|
| Fuel Consumption [litres/100 km] | 15.39 | 14.97† | −2.7% |

†average
‡ per 65 litre fuel tank at test condition

These results demonstrate that the use of additives (a) and (b) decreased the consumption of an HVO fuel and increased the vehicle range.

This may be converted to an expected vehicle range, for example based on a 65 litre fuel tank at test condition as in Table 6:

TABLE 6

| | Base Fuel | Additised Base fuel 1 | Change |
|---|---|---|---|
| Vehicle Range‡ [km] | 422.46 | 434.20 | +2.7% |

The invention claimed is:

1. A method of reducing the impact of deposits in a post combustion system of a diesel engine, the method comprising combusting in the engine a diesel fuel composition comprising as additives:

(a) one or more quaternary ammonium salts; and (b) one or more compounds which are a product of a Mannich reaction between an (b1) aldehyde, (b2) an amine and (b3) an optionally substituted phenol, wherein the diesel fuel composition comprises at least 25 vol % of renewable diesel;

wherein the post combustion system of the diesel engine comprises a diesel particulate filter; and wherein the method comprises reducing the formation of deposits in the diesel particulate filter.

2. The method of claim 1, wherein the diesel fuel composition is a biodiesel 100% derived from renewable sources.

3. The method of claim 2, wherein the diesel fuel composition is neat hydrotreated triglyceride oil.

4. The method of claim 1, wherein additive (a) is one or more quaternised reaction product of (a1) a hydrocarbyl-substituted acylating agent and (a2) a compound comprising at least one tertiary amine group and a primary amine, secondary amine or alcohol group.

5. The method of claim 4, wherein (a1) is a polyisobutylene-substituted succinic anhydride having a PIB molecular weight (Mn) of 700 to 1300.

6. The method of claim 4, wherein (a2) is N,N-dimethylaminopropylamine, N,N-diethylaminopropylamine or N,N-dimethylamino ethylamine.

7. The method of claim 1, wherein additive (a) comprises a quaternary ammonium salt formed by reacting methyl salicylate, dimethyl oxalate or propylene oxide (optionally in combination with an acid) with the reaction product of (a1) a polyisobutylene-substituted succinic anhydride having a PIB molecular weight (Mn) of 700 to 1300 and (a2) dimethylaminopropylamine.

8. The method of claim 1, wherein additive (b) is one or more reaction products of (b1) formaldehyde, (b2) polyethylene polyamine and (b3) a para-substituted monoalkyl phenol.

9. The method of claim 8, wherein additive (b) is one or more reaction products of (b1) formaldehyde, (b2) ethylene diamine and (b3) dodecyl phenol.

10. The method of claim 1, wherein additive (b) is formed by reacting (b1), (b2) and (b3), in a molar ratio of 1.1-5 parts (b1) to 1 part (b2) to 1.1-2 parts (b3).

11. The method of claim 1, wherein the diesel fuel composition further comprises, as an additive, (c) at least one reaction product of a carboxylic acid-derived acylating agent and an amine.

12. The method of claim 11, wherein additive (c) comprises the reaction product of (c1) a polyisobutene-substituted succinic acid or succinic anhydride and (c2) a polyethylene polyamine selected from ethylenediamine, diethylenetriamine, triethylenetetramine, tetraethylenepentamine, pentaethylenehexamine, hexaethylene-heptamine and mixtures and isomers thereof; wherein the polyisobutene substituent has a number average molecular weight of between 500 and 2000.

13. The method of claim 1, wherein the diesel fuel composition comprises from 1 to 1000 ppm of (a) and from 1 to 1000 ppm of (b).

14. The method of claim 11, wherein the diesel fuel composition comprises from 1 to 1000 ppm of (c).

15. The method of claim 1, which reduces the accumulation of soot in a diesel particulate filter.

16. The method of claim 1, which reduces the formation of deposits on a turbocharger of the post combustion system.

17. The method of claim 1, which reduces the formation of deposits on a diesel oxidation catalyst of the post combustion system.

18. The method of claim 1, which reduces the formation of deposits on a selective catalytic reduction unit of the post combustion system.

19. The method of claim 1, which reduces the formation of deposits on an ammonia oxidation catalyst of the post combustion system.

20. The method of claim 1, which reduces the formation of deposits on sensors within the post combustion system.

21. The method of claim 1, which reduces the formation of deposits in one more components of the post combustion system by at least 5%.

22. The method of claim 1, which increases the interval between regenerations of a diesel particulate filter by at least 30 minutes.

23. The method of claim 1, wherein the diesel engine is an off-road engine, a rail, or stationary engine.

24. The method of claim 1, which provides one or more benefits selected from: an increase in power generation; an increase in torque; an increase in fuel economy; a reduction in emissions; a reduction in combustion chamber deposits; an acceleration improvement; driveability improvements; a reduction in cold start issues; lower soot formation; mitigation of lubricant degradation and/or performance loss; a reduction in diesel exhaust fluid and consumption; reduction in wear on all post combustion components; increased longevity of exhaust components; an increase in the maintenance period for the engine and/or post combustion components; the protection of intake components downstream of the EGR, throttles and the intake manifold; a reduction in fuel consumption; and an increase in vehicle range.

* * * * *